US007772508B2

(12) United States Patent
Kiyono et al.

(10) Patent No.: US 7,772,508 B2
(45) Date of Patent: Aug. 10, 2010

(54) SWITCH HAVING A BASE, A SLIDER, AND A CONDUCTIVE COIL SPRING

(75) Inventors: Yasuhiro Kiyono, Nagaokakyo (JP); Toshihiro Naruo, Kyoto (JP)

(73) Assignee: OMRON Corporation, Kyoto (JP)

( * ) Notice: Subject to any disclaimer, the term of this patent is extended or adjusted under 35 U.S.C. 154(b) by 478 days.

(21) Appl. No.: 11/821,932

(22) Filed: Jun. 26, 2007

(65) Prior Publication Data

US 2007/0295586 A1 Dec. 27, 2007

(30) Foreign Application Priority Data

Jun. 27, 2006 (JP) ..... 2006-176550

(51) Int. Cl.
*H01H 15/02* (2006.01)

(52) U.S. Cl. ..... 200/16 D; 200/553

(58) Field of Classification Search ..... 200/16 R, 200/16 A, 16 B, 16 C, 16 D, 553, 557–564, 200/332, 335, 336, 339
See application file for complete search history.

(56) References Cited

U.S. PATENT DOCUMENTS 7,135,651 B2 * 11/2006 Lung ..... 200/559
7,223,931 B2 * 5/2007 Kiyono et al. ..... 200/563

FOREIGN PATENT DOCUMENTS

| | | |
|---|---|---|
| JP | 2000-243184 | 9/2000 |
| JP | 2002-216589 | 8/2002 |
| JP | 2006318749 A * | 11/2006 |

* cited by examiner

*Primary Examiner*—Renee S Luebke
*Assistant Examiner*—Marina Fishman
(74) *Attorney, Agent, or Firm*—Osha Liang LLP

(57) ABSTRACT

A thin switch having a small floor area easy to be manufactured is provided. A switch includes a base including at least one switching fixed contact point exposed from a bottom surface and a concave part having at least one pair of opposing side walls; an operation lever pivotally supported by the side walls of the base; a slider slidably arranged on the bottom surface of the base for sliding while being guided by the opposing side walls of the base when pushed by a cam part of the operation lever; and a conductive coil spring arranged on the bottom surface of the base so as to extend and contract with push and release by the slider, including an arm part on a first end side arranged to be slidable on the bottom surface of the base and arranged so as to contact and separate with respect to the switching fixed contact point. A shaft center of the coil spring is arranged parallel to a moving direction of the slider.

9 Claims, 35 Drawing Sheets

SWITCH HAVING A BASE, A SLIDER, AND A CONDUCTIVE COIL SPRING

BACKGROUND OF THE INVENTION

1. Field of the Invention

The present invention relates to switches, and in particular, to a switch to be surface mounted on a print substrate and the like.

2. Description of the Related Art

Conventionally, the switch to be surface mounted includes a switch in which an operation body 16 is pushed down to flip a movable contacting point body 14 made of arch shaped elastic metal thin plate, thereby opening and closing a contacting point (refer to Japanese Patent Application Laid-Open No. 2000-243184).

The switch may also be a switch in which an operation lever 5 is pushed and a movable contacting point 4 including a coil spring is twisted to contact or separate a second arm 4c with respect to a switch contacting point 3, thereby opening and closing a contacting point (refer to Japanese Patent Application Laid-Open No. 2002-216589).

However, the entire movable contacting point body 15 must be enlarged to ensure a desired contacting pressure and the life of the contacting point since the movable contacting body 14 is configured by an arch shaped plate spring in the former case, and thus a compact switch having a small floor area cannot be obtained.

In the latter case, the switch main body becomes tall since the second arm 4c of the movable contacting point 4 displaces in the up and down direction, and thus thinning has limitations. Furthermore, high component precision and assembly precision are required since the switch contacting point 3 to which the second arm 4c of the movable contacting point 4 contacts has a complex shape, and thus manufacturing is troublesome and an inexpensive switch cannot be obtained.

SUMMARY OF THE INVENTION

In view of the above problems, the present invention aims to provide a thin switch having a small floor area and easy to be manufactured.

In order to solve the above problem, a switch according to the present invention includes a base including a common fixed contact point exposed from an inner surface and at least one switching fixed contact point exposed from a bottom surface; an operation lever pivotally supported by the base; a slider slidably arranged on the bottom surface of the base for sliding when pushed by a cam part of the operation lever; and a conductive coil spring arranged on the bottom surface of the base so as to extend and contract with push and release by the slider, including an arm part arranged so as to contact the common fixed contact point on a first end side and contact and separate with respect to the switching fixed contact point on a second end side, where a shaft center of the coil spring is arranged parallel to a moving direction of the slider.

According to the present invention, when the operation lever is pivoted and the slider is sled, the conductive spring contacts, whereby the arm part thereof contacts and separates with respect to the switching fixed contact point to switch the contacting point. Thus, the entire arch shaped spring does not need to be enlarged as in the prior art even in ensuring the desired contact point pressure and the life of the contact point, and a switch having a small floor area can be obtained.

In particular, contact reliability is high since the contact force of the arm part with respect to the bottom surface of the base is substantially constant even if the coil spring is extended or contracted in the sliding direction and tension force and compression force are changed.

Furthermore, since the conductive coil spring extends and contracts in the shaft center direction, the switch main body does not become tall as in the prior art, and thinning is facilitated. Moreover, the common fixed contact point and the switching fixed contact point may be merely exposed from the inner surface and the bottom surface of the base. Thus, high component precision and assembly precision as in the prior art are unnecessary, and an inexpensive switch that is easy to manufacture and that has a stable operating characteristic can be obtained.

Furthermore, manufacturing of switches such as always-closed contacting type or always-opened contacting point time becomes possible by simply selecting the arrangement of the switching fixed contact point, as necessary, and the operating direction is readily changed by simply changing the shape of the operation lever. Therefore, various types of switches can be obtained through combination of components, whereby commoditization of the components is facilitated, and a more inexpensive switch can be obtained.

According to an embodiment of the present invention, the shaft center of the coil spring may intersect a central part of the slider.

According to such an embodiment, a switch in which the spring force of the coil spring is evenly transmitted to the slider, and the slide is smoothly sled is obtained.

According to another embodiment of the present invention, the shaft center of the coil spring may intersect the slider at a position deviated from a central part thereof.

According to such an embodiment, stable operation is ensured since the slider is guided by the side walls even if the spring force of the coil spring is biased and transmitted to the slider. The space efficiency is improved, and a more compact switch having a small floor area can be obtained.

According to another further embodiment of the present invention, a coil part of the coil spring may contact a common fixed contact point exposed from the bottom surface of the base.

According to such an embodiment, the common fixed contact point is exposed from the bottom surface of the base, similar to the switching fixed contact point, and thus a switch in which the assembly task is facilitated and the productivity is high is obtained.

According to a different embodiment of the present invention, the arm part on a second end side of the coil spring may contact the common fixed contact point exposed from an inner side surface of the base.

According to such an embodiment, an advantage in that a switch in which a second end of the coil spring constantly pressure contacts the common fixed contact point with the spring force of the compressed coil spring and thus has a high contact reliability is obtained in addition to the above advantages.

DETAILED DESCRIPTION OF THE PREFERRED EMBODIMENTS

Figure 1A:
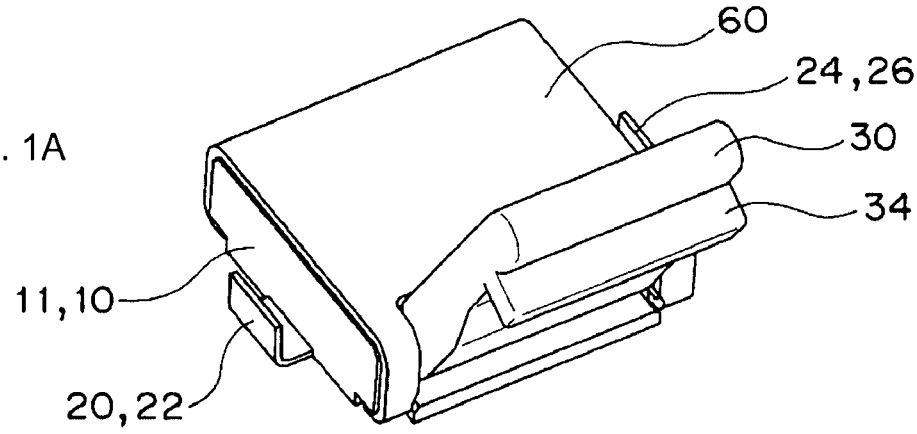
FIG. 1A, and FIGS. 1B and 1C respectively show a perspective view of a first embodiment of a switch according to the present invention, and perspective views of before and after the operation in which the cover is detached.
Figure 1B:
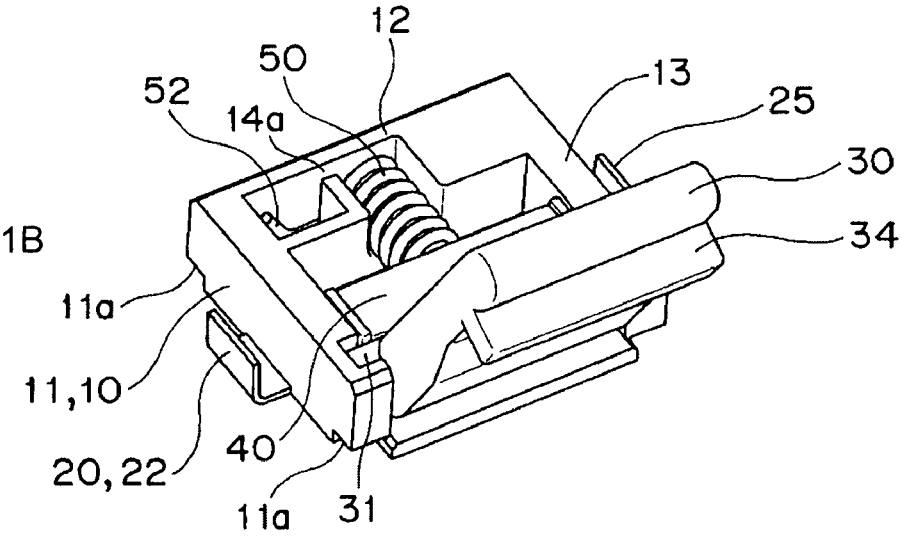
Figure 1C:
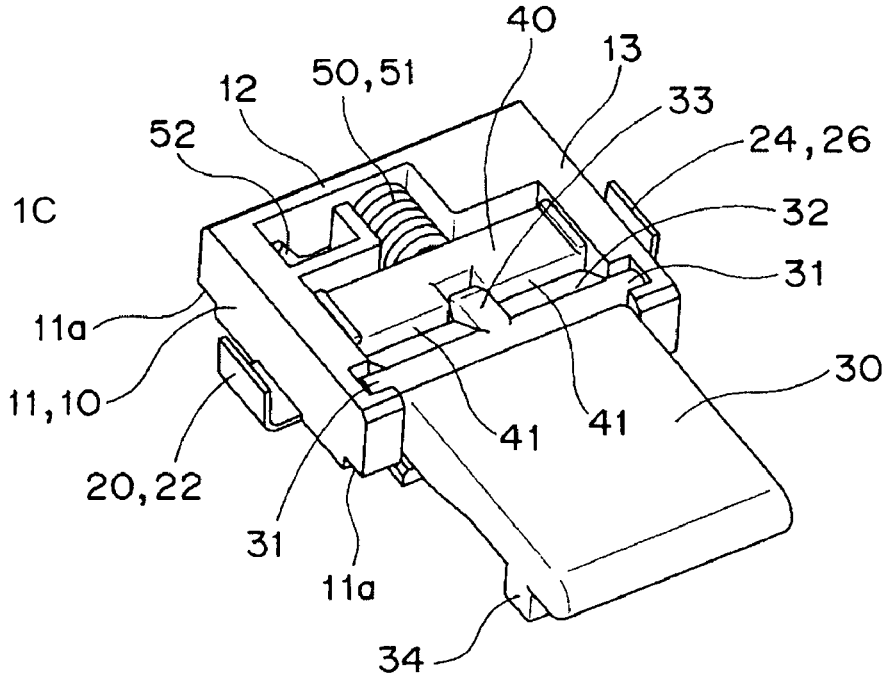

Embodiments of the present invention will now be described according to the accompanying drawings FIGS. 1 to 35.

The first embodiment is a case in which application is made to a switch having an always-opened contacting point, as shown in FIGS. 1 to 5.

That is, the switch is configured by a base 10 having a square plane in which a common fixed contact point terminal 20 and a switching fixed contact point terminal 24 are insert molded; an operation lever 30 pivotally supported by the base 10; a slider 40 that slides when pushed by the operation lever 30; a conductive coil spring 50 that extends and contracts with push and release of the slider 40; and a cover 60 for covering the base 10. An actually assembled product has an outer dimension of the entire height excluding the lever of 0.9 mm, the base width of 3.0 mm, and the length of 3.5 mm by way of example.

Figure 2A:
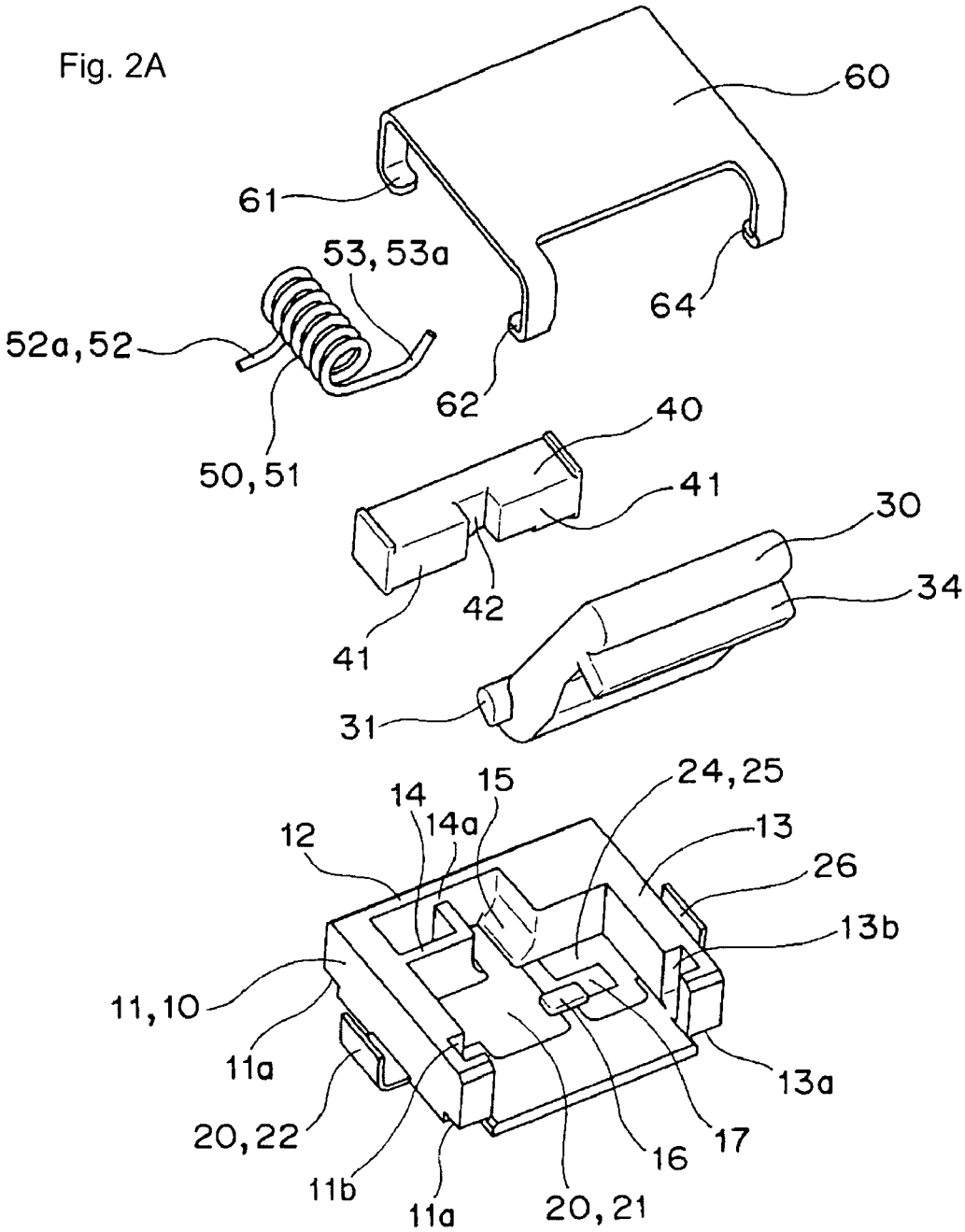
FIG. 2A shows an exploded perspective view of the switch shown in FIG. 1A.
Figure 2B:
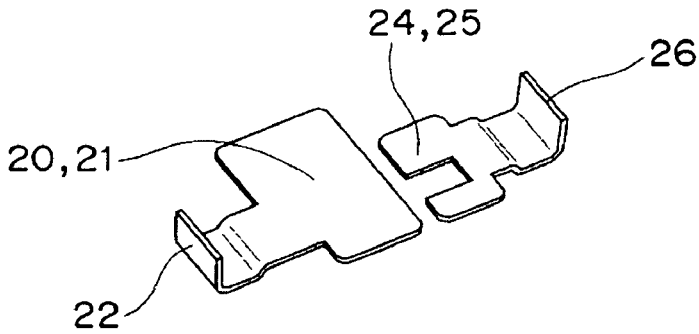
FIG. 2B shows a perspective view showing only the terminals of the base shown in FIG. 2A.

As shown in FIG. 2, the base 10 has side walls 11, 12, and 13 continuously formed in a projecting manner along the peripheral edge of the upper surface, and has the common fixed contact point terminal 20 and the switching fixed contact point terminal 24 insert molded to the opposing side walls 11 and 13. The base 10 further has positioning steps 11*a*, 11*a*, and 13*a*, 13*a* (not shown) for engaging engagement nails 61, 62, 63 (not shown), and 64 of the cover 60, to be hereinafter described, at both side edges of the bottom surface of the side wall 11 and the side wall 13. Furthermore, bearing concave parts 11*b*, 13*b* are formed on the same shaft center at the edges of the opposing inner side surfaces of the side walls 11, 13. A projection 14 having a substantially L-shape is arranged in a projecting manner at the corner of the inner bottom surface of the base 10, and an accommodating groove 15 for accommodating the coil spring 50, to be hereinafter described, is formed therein. A cut-out 14*a* is formed at a first end of the projection 14.

The common fixed contact point terminal 20 has a common fixed contact point 21 exposed from the inner bottom surface of the base 10, and a terminal part 22, which is bent upward at substantially right angle, projected towards the side from the outer surface of the side wall 11. The switching fixed contact point terminal 24 has a switching fixed contact point 25 exposed from the inner bottom surface of the base 10 and a terminal part 26, which is bent upward at substantially right angle, projected towards the side from the outer surface of the side wall 13. A float-preventing projection 16 for preventing the fixed contact points 21, 25 from floating is arranged in a projecting manner at the inner bottom surface of the base 10, and an insulation part 17 is also formed.

The operation lever 30 has a pair of shaft parts 31, 31 arranged in a projecting manner on the same shaft center from both side edges, and a cam part 32 arranged between the shaft parts 31, 31. An angular position regulating projection 33 is arranged in a projecting manner at the central part of the cam part 32. The operation lever 30 has a position regulating projection 34 arranged in a projecting manner at the lower surface of the free end side.

Therefore, the operation lever 30 is pivotally supported by fitting the shaft parts 31, 31 of the operation lever 30 to the bearing concave parts 11*b*, 13*b* of the base 10, and stopped from pivoting by the position regulating projection 34.

The slide strip 40 has a rectangular solid shape that slides while being guided on the inner side surfaces of the side walls 11, 13 of the base 10. As shown in FIG. 2A, a pressure receiving surface 41 for receiving pushing force from the cam part 32 of the operation lever 30 is formed on the side surface on the near side, and a position regulating concave part 42 is arranged at the central part of the pressure receiving surface 41. A slip-off preventing projection 43A (FIG. 3A), which prevents the coil spring 50 to be described later from slipping off, is arranged in a projecting manner at the side surface on the side opposite to the pressure receiving surface 41.

The conductive coil spring 50 has a function of a compression spring and a torsion spring, and has arm parts 52, 53 extending in opposite directions from both ends of a cylindrical coil part 51. The free ends of the arm parts 52, 53 are bent to respectively form contacting point parts 52*a*, 53*a*.

The cover 60 has a plane shape capable of covering the base 10, and includes engagement nails 61, 62, 63 (not shown), and 64 formed by being extended from the corners on the outer periphery and folded back perpendicularly.

Figure 3A:
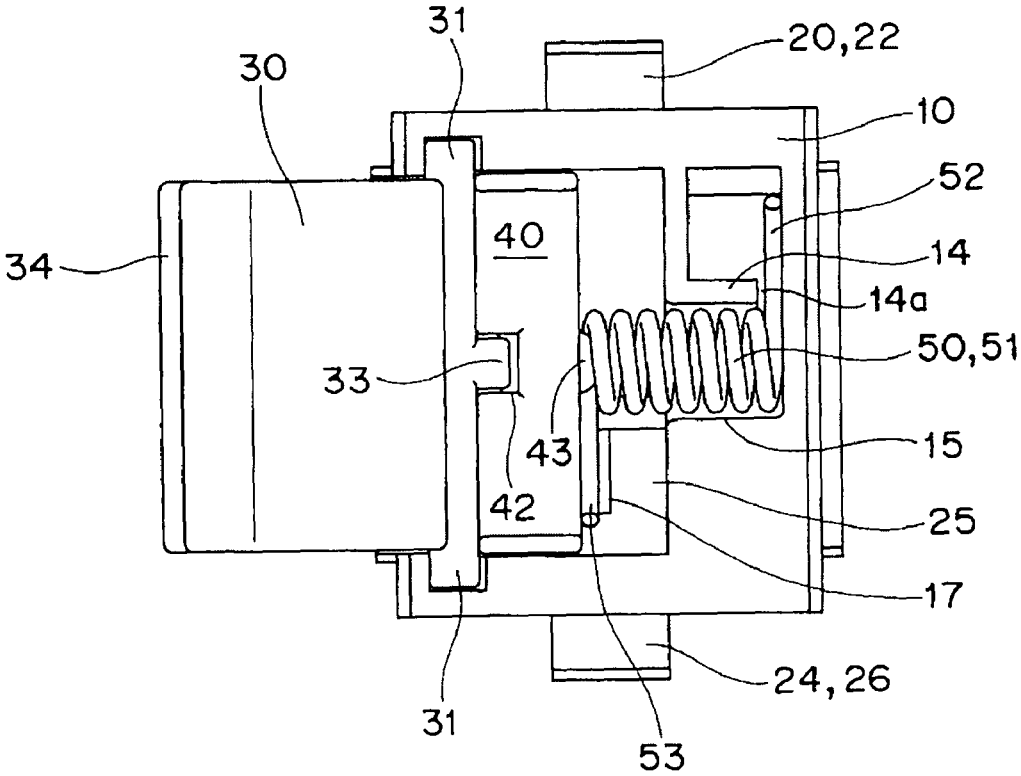
FIGS. 3A and 3B respectively show a plan view of before the operation in which the cover is detached, and a cross sectional view of before the operation in which the cover is attached.
Figure 3B:
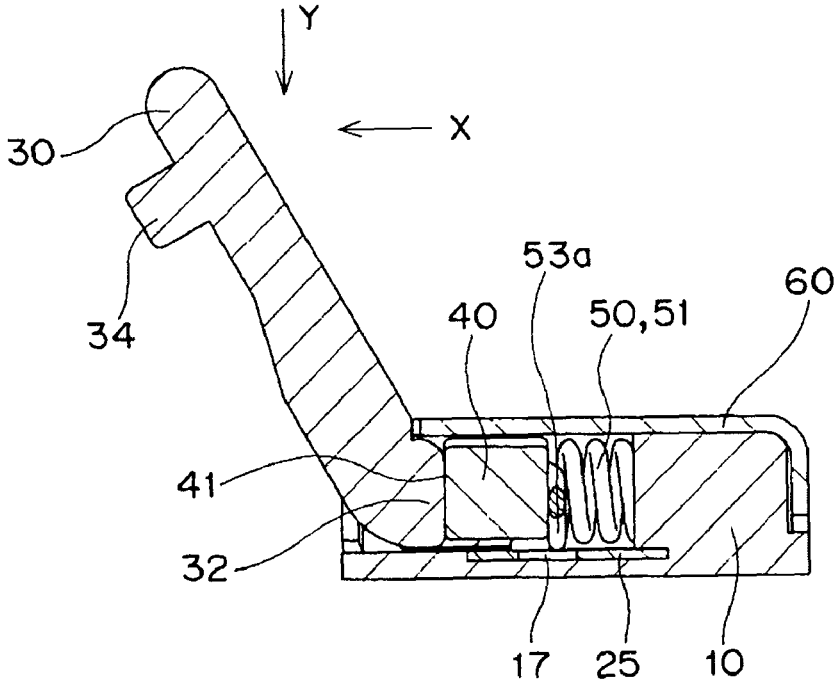
Figure 4A:
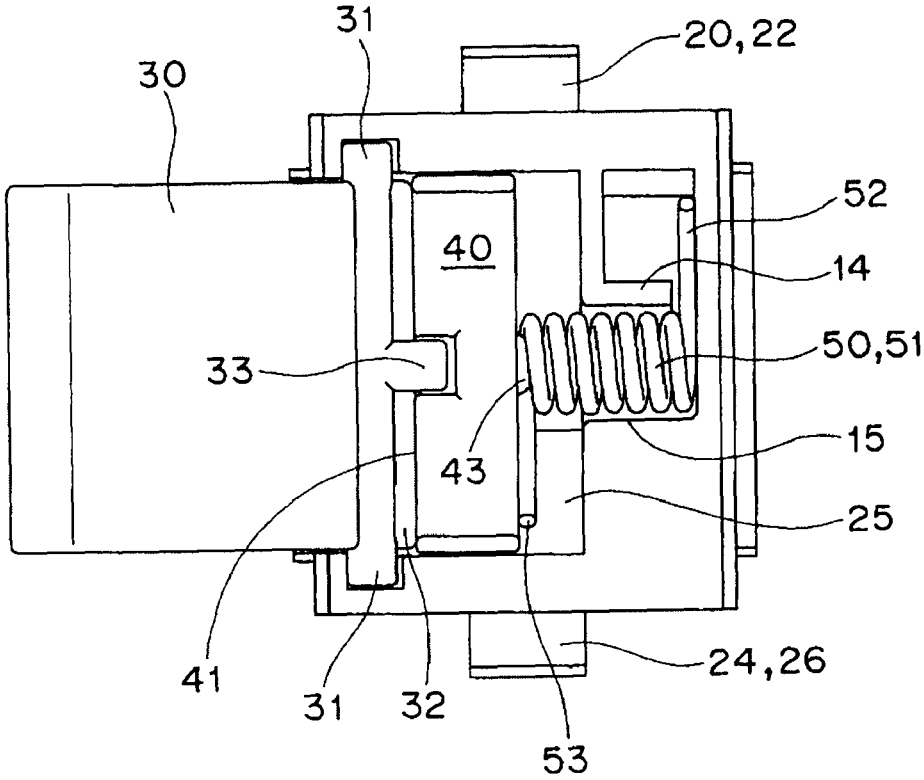
FIGS. 4A and 4B respectively show a plan view in middle of the operation in which the cover is detached, and a cross sectional view in middle of the operation in which the cover is attached.
Figure 4B:
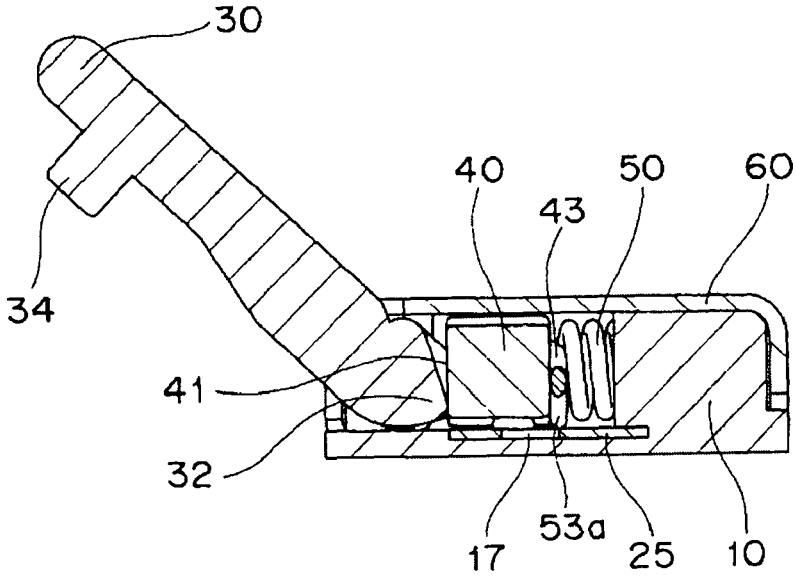

In order to assemble the switch according to the present embodiment, the slider 40 is slidably arranged between the inner side surfaces of the side walls 11, 13 of the base 10, as shown in FIGS. 2 to 4. The coil part 51 of the coil spring 50 is accommodated in the accommodating groove 15 of the base 10, and the arm part 52 of the coil spring 50 is engaged to the cut-out 14*a* of the base 10 and the arm part 53 is positioned at the insulation part 17. The coil part 51 of the coil spring 50 is slightly floated from the bottom surface at this point. Subsequently, the cam part 32 of the operation lever 30 pressure contacts the pressure receiving surface 41 of the slide strip 40 by fitting the pair of shaft parts 31, 31 of the operation lever 30 to the bearing concave parts 11*b*, 13*b* of the base 10. Furthermore, the cover 60 is attached to the base 10 from above while maintaining the above state, thereby pushing down the floating coil spring 50 against the bottom surface of the base 10. The engagement nails 61, 62, 63 (not shown), and 64 of the cover 60 are respectively folded back and engaged to the positioning steps 11*a*, 13*b* of the base 10, and the assembling is completed.

According to the present embodiment, torsion and compression are produced in the coil spring 50 by pushing the floating coil spring 50 with the cover 60 to be accommodated in the accommodating groove 15 of the base 10. Thus, the contacting point part 52*a* on a first end side of the coil spring 50 pressure contacts the common fixed contact point 21 with a predetermined contact force, and the contacting point part 53*a* on a second end side of the coil spring 50 pressure contacts the insulation part 17 of the base 10 with a predetermined contact force. Furthermore, the coil spring 50 provides returning force to the operation lever 30 through the slider 40.

As shown in FIG. 3, when external force is loaded to the operation lever 30 in the direction of the arrow X or Y the operation lever 30 pivots with the shaft part 31 as the center against the spring force of the coil spring 50. The cam part 32 of the operation lever 30 then pushes the pressure receiving surface 41 of the slider 40, and the slider 40 slides on the base 10, thereby compressing the coil part 51 of the coil spring 50. The contacting point 53*a* of the coil spring 50 thus slides on the insulation part 17 of the base 10, and contacts a switching fixed contact point 25, as shown in FIG. 4. The common fixed contact point 21 and the switching fixed contact point 25 are thereby short circuited by way of the coil spring 50, and the fixed contact point terminals 20, 24 become electrically conductive.

Figure 5A:
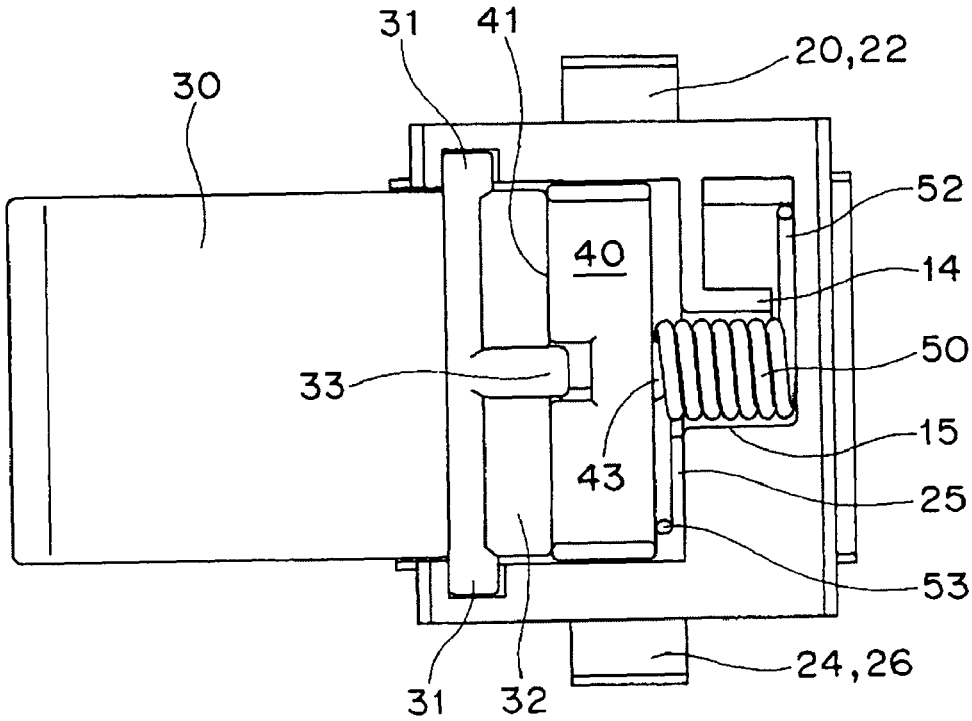
FIGS. 5A and 5B respectively show a plan view of after the operation in which the cover is detached, and a cross sectional view of after the operation in which the cover is attached.
Figure 5B:
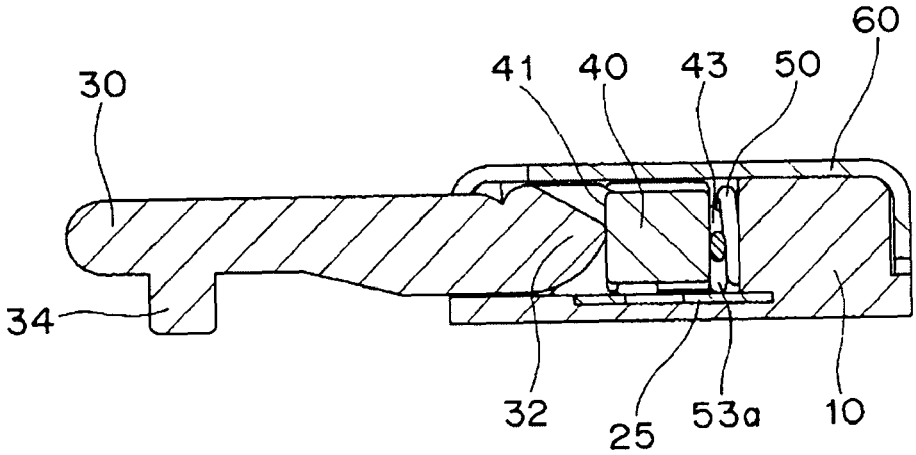
Figure 6A:
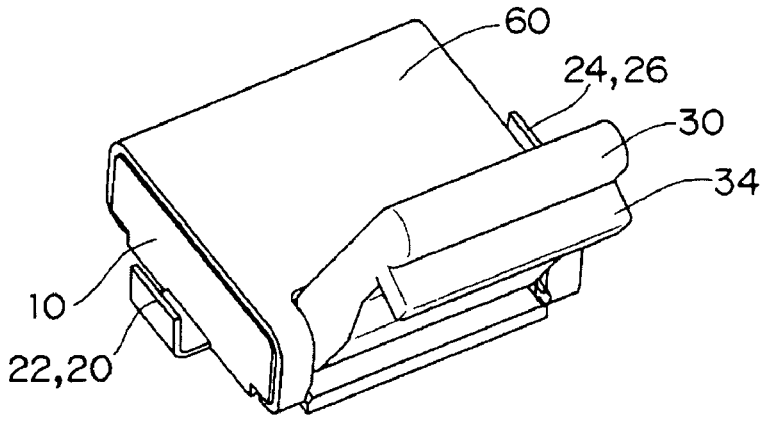
FIG. 6A, and FIGS. 6B and 6C respectively show a perspective view of a second embodiment of a switch according to the present invention, and perspective views of before and after the operation in which the cover is detached.
Figure 6B:
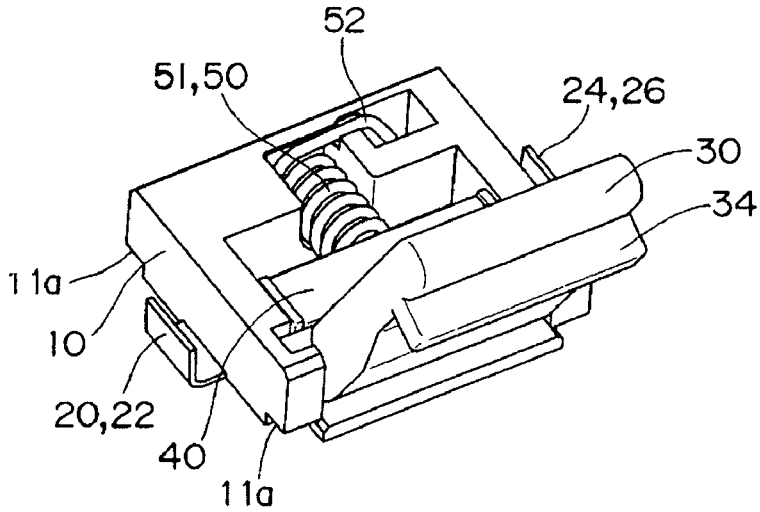
Figure 6C:
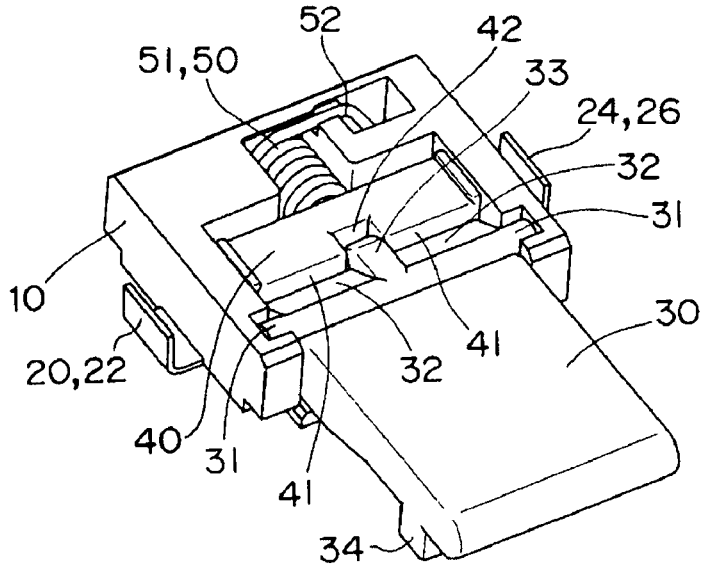

Furthermore, when the operation lever 30 is pushed in, the contacting point part 53*a* of the arm part 53 slides on the fixed contact point 25, and the fixed contact point terminals 20, 24 maintain the conduction state, as shown in FIG. 5. When the operation lever 30 is further pushed in, the projection 34 of the operation lever 30 contacts the floor surface, and the operation lever 30 stops.

When the load is thereafter released, the operation lever 30 is pushed back by way of the slider 40 by the spring force of the coil spring 50, and the contacting point part 53*a* of the coil spring 50 opens and separates from the fixed contact point 25 and contacts the insulation part 17, whereby the fixed contact point terminals 20, 24 become non-electrically conductive.

The basic configuration of the second embodiment according to the present invention is substantially the same as the first embodiment described above, as shown in FIGS. 6 to 10, but differs in the connecting configuration of the coil spring 50 with respect to the common fixed contact point terminal 20.

That is, the projection 14 having a substantially L-shape is arranged in a projecting manner at a corner different from the first embodiment of the inner bottom surface of the base 10 and the accommodating groove 15 is formed therein, and the cut-out 14*a* is formed at a first end of the projection 14.

Figure 7A:
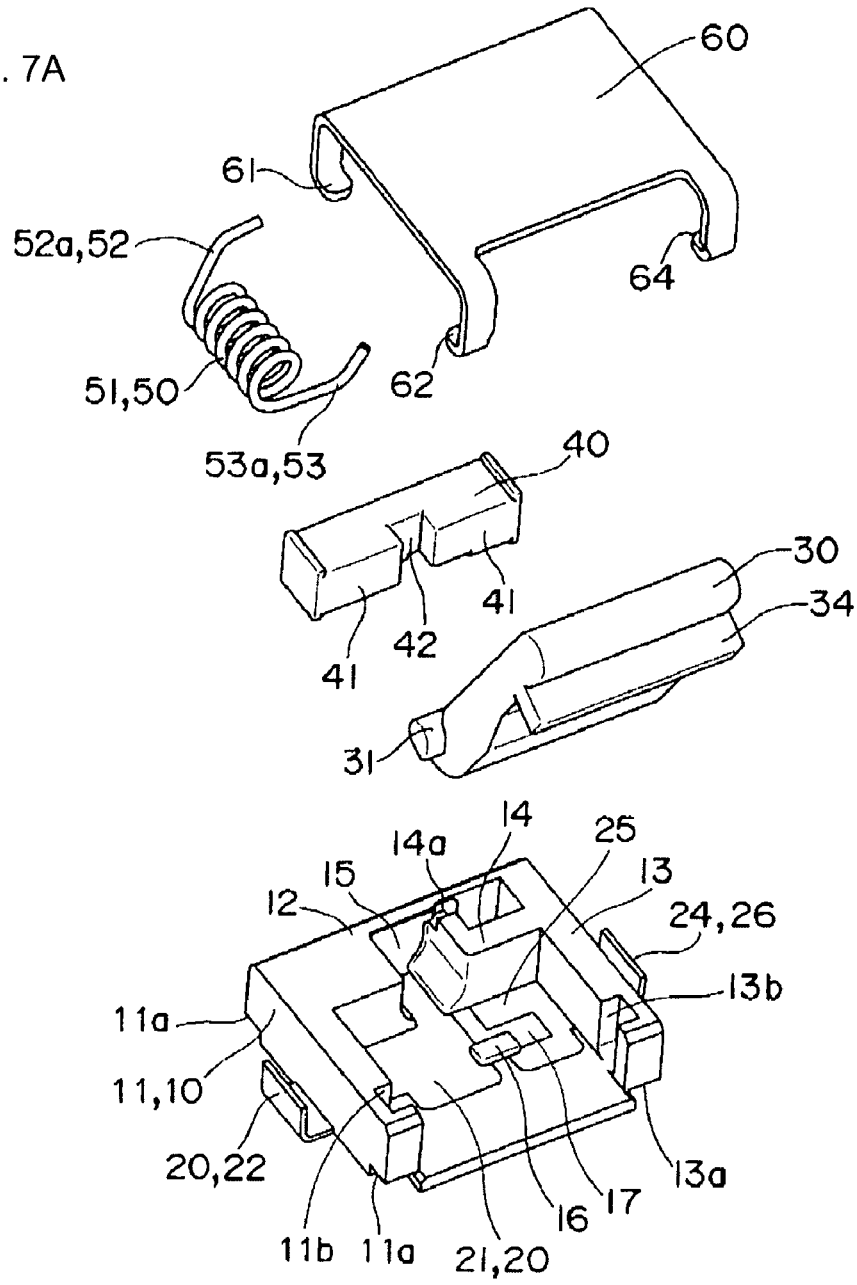
FIG. 7A shows an exploded perspective view of the switch shown in FIG. 6A.
Figure 7B:
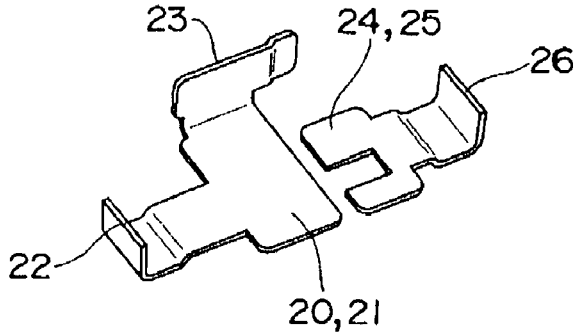
FIG. 7B shows a perspective view showing only the terminals of the base shown in FIG. 7A.

The common fixed contact point terminal 20 has the edge part of the common fixed contact point 21 extended and bent upward to form a second common fixed contact point 23, as shown in FIG. 7B. The second common fixed contact point 23 is thus exposed by insert molding the common fixed contact point terminal 20 in the base 10.

The coil spring 50 has the arm parts 52, 53 extending in a substantially perpendicular direction from both ends of the cylindrical coil part 51, as shown in FIG. 7A. The free ends of the arm parts 52, 53 are bent to respectively form contacting point parts 52*a*, 53*a*.

The slider 40 is slidably arranged between the inner side surfaces of the side walls 11, 13 of the base 10. The coil part 51 of the coil spring 50 is compressed and accommodated in the accommodating groove 15 of the base 10, and the arm part 52 of the coil spring 50 is positioned at the cut-out 14*a* of the base 10, and the arm part 53 is positioned at the insulation part 17. In this case, the arm part 52 of the coil spring 50 is in a substantially perpendicularly standing state. Subsequently, the cam part 32 of the operation lever 30 pressure contacts the pressure receiving surface 41 of the slide strip 40 by fitting the pair of shaft parts 31 of the operation lever 30 to the bearing concave parts 11*b*, 13*b* of the base 10. Furthermore, the cover 60 is attached to the base 10 from above while maintaining the above state, thereby pushing down the standing arm part 52 to the cut-out 14*a*. The engagement nails 61, 62, 63 (not shown), and 64 of the cover 60 are then respectively folded back and engaged to the positioning steps 11*a*, 13*b* of the base 10, and the assembling is completed.

According to the present embodiment, torsion is produced in the coil spring 50 by pushing down the standing arm part 52 with the cover 60 to engage with the cut-out 14*a*. Thus, the contacting point part 53*a* on a first end side of the coil spring 50 pressure contacts the insulation part 17 of the base 10 with a predetermined contact force. Furthermore, since the coil spring 50 is compressed and held in the accommodating groove 15, the arm part 52 of the coil spring 50 pressure contacts the second common fixed contact point and provides returning force to the operation lever 30 through the slider 40.

Figure 8A:
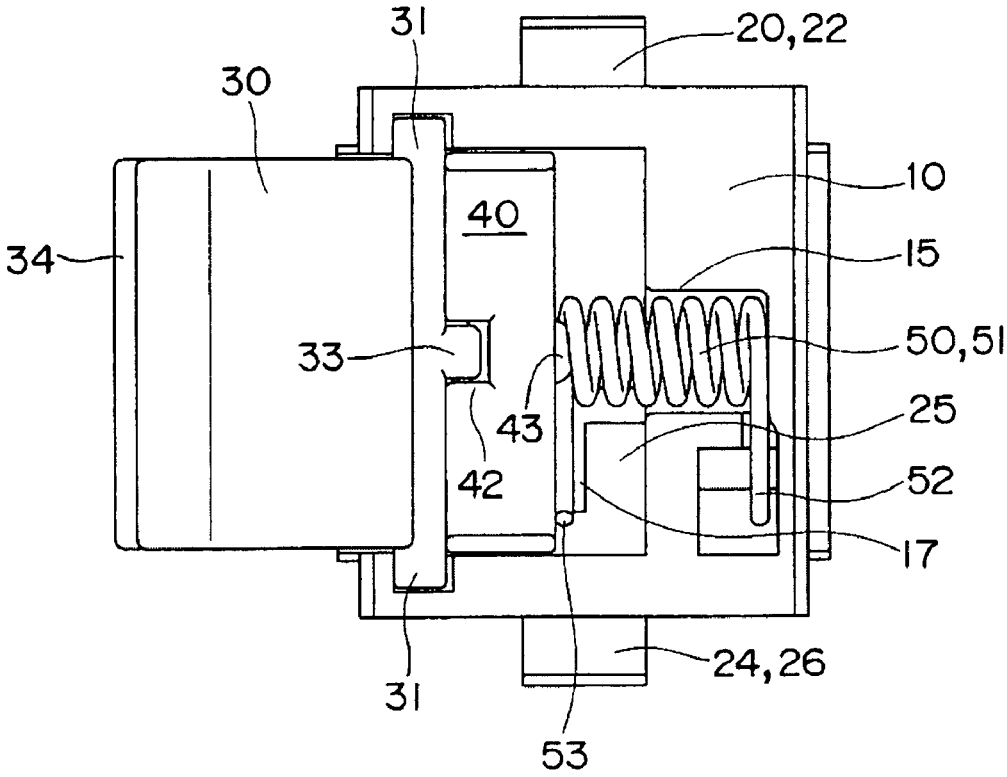
FIGS. 8A and 8B respectively show a plan view of before the operation in which the cover is detached, and a cross sectional view of before the operation in which the cover is attached.
Figure 8B:
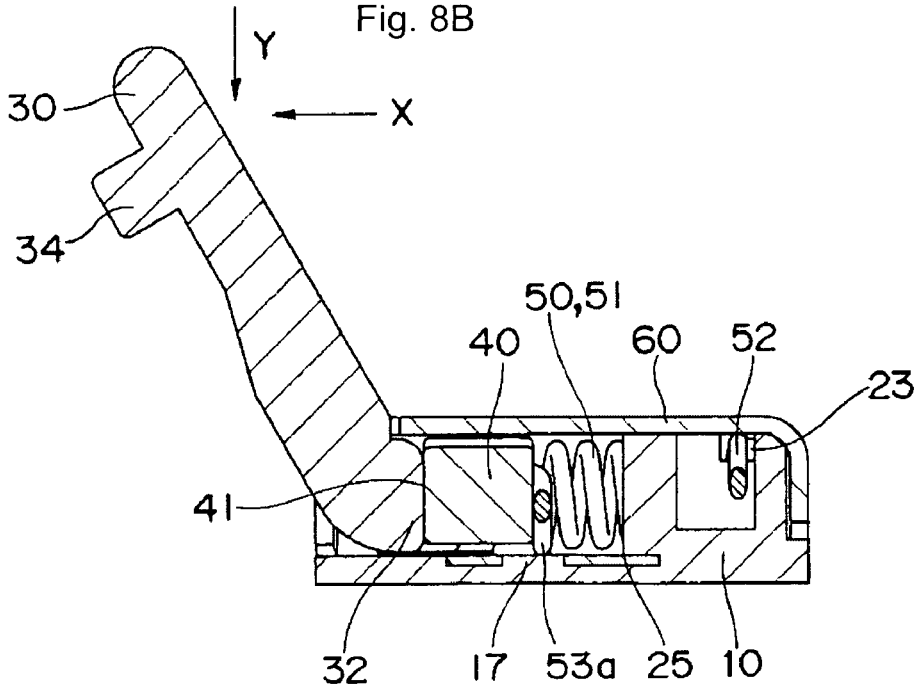
Figure 9A:
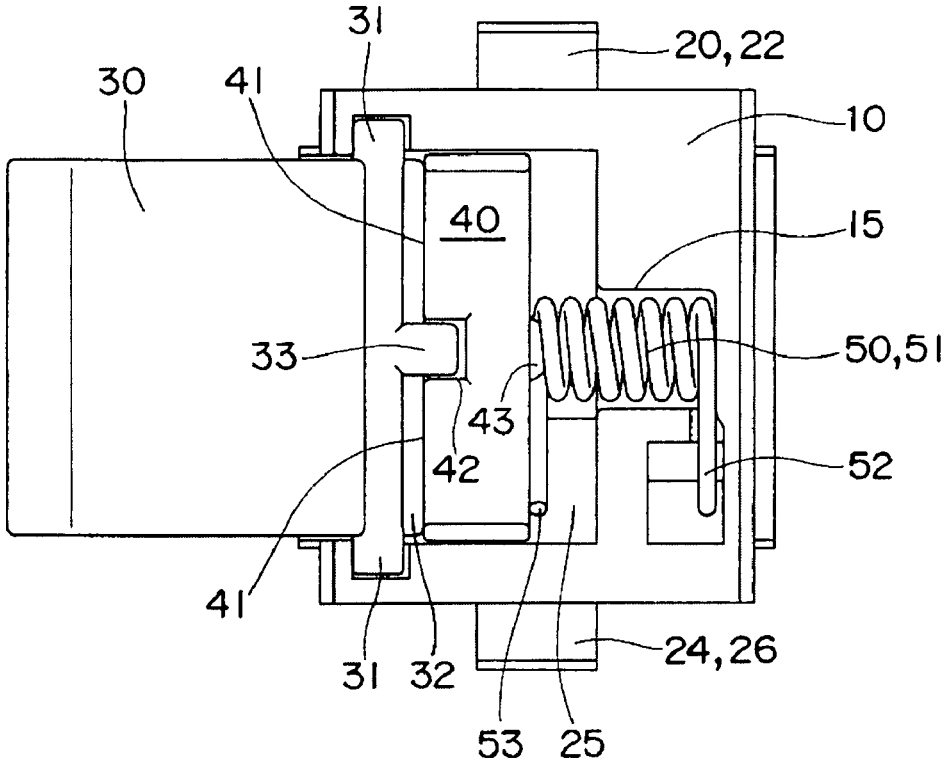
FIGS. 9A and 9B respectively show a plan view in middle of the operation in which the cover is detached, and a cross sectional view in middle of the operation in which the cover is attached.
Figure 9B:
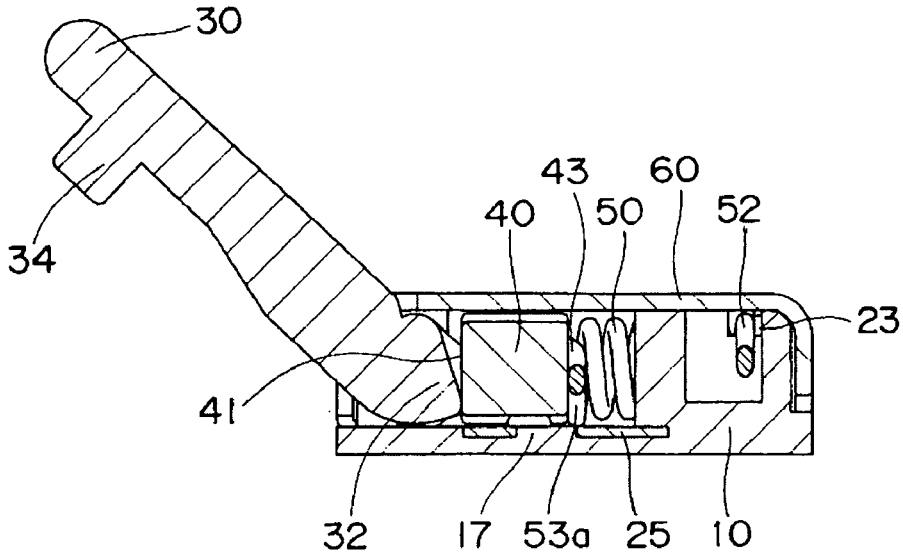

As shown in FIG. 8, when external force is loaded to the operation lever 30 in the direction of the arrow X or Y, the operation lever 30 pivots with the shaft part 31 as the center against the spring force of the coil spring 50. The cam part 32 of the operation lever 30 then pushes the pressure receiving surface 41 of the slider 40, and the slider 40 slides on the base 10, thereby compressing the coil part 51 of the coil spring 50. The contacting point 53*a* of the coil spring 50 thus slides on the insulation part 17 of the base 10, and contacts a switching fixed contact point 25, as shown in FIG. 9. The second common fixed contact point 23 and the switching fixed contact point 25 are thereby short circuit by way of the coil spring 50, and the fixed contact point terminals 20, 24 become electrically conductive.

Figure 10A:
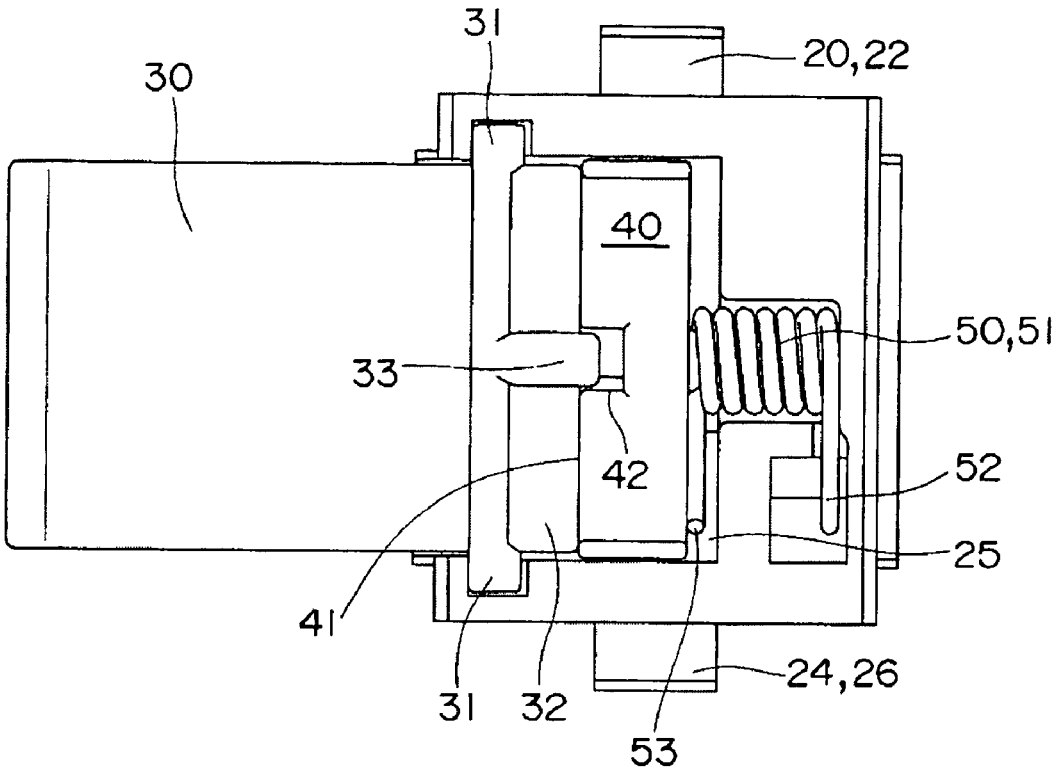
FIGS. 10A and 10B respectively show a plan view of after the operation in which the cover is detached, and a cross sectional view of after the operation in which the cover is attached.
Figure 10B:
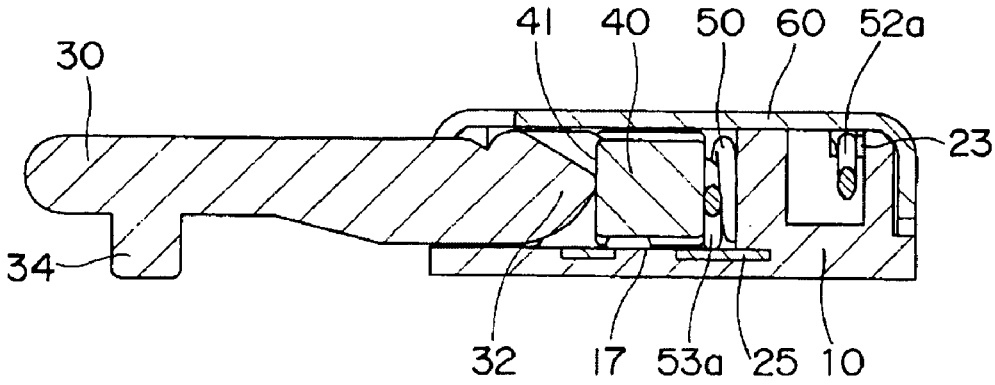
Figure 11A:
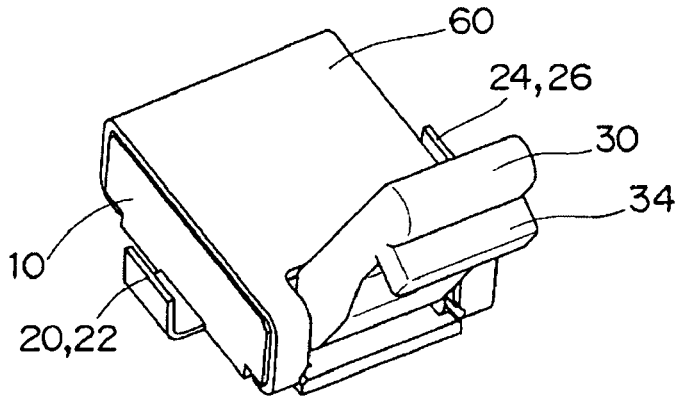
FIG. 11A, and FIGS. 11B and 11C respectively show a perspective view of a third embodiment of a switch according to the present invention, and perspective views of before and after the operation in which the cover is detached.
Figure 11B:
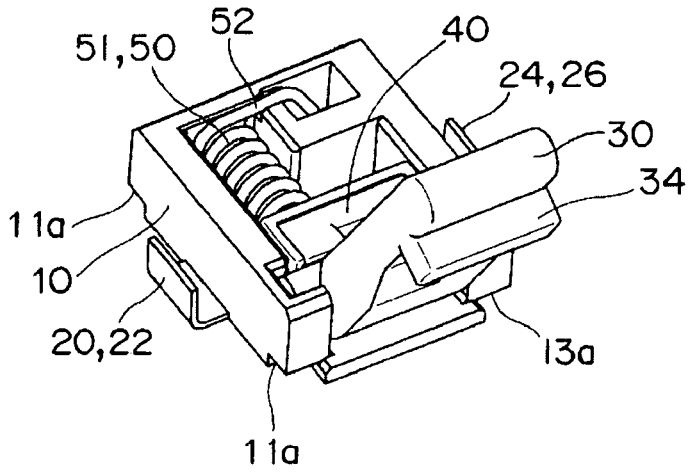
Figure 11C:
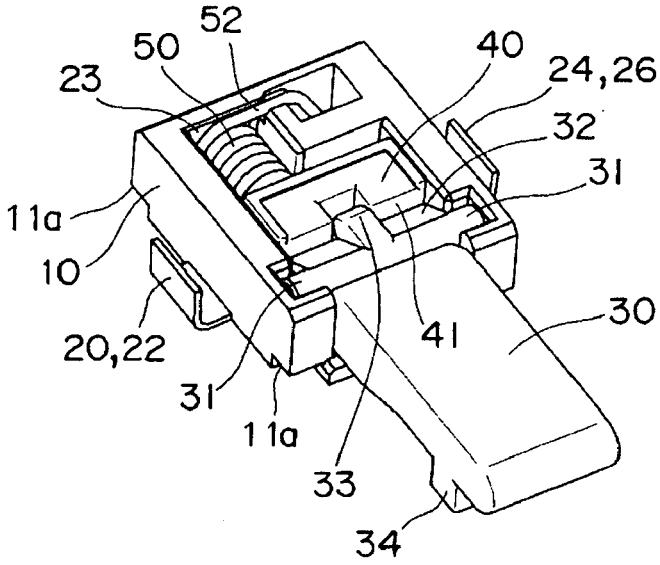
Figure 12A:
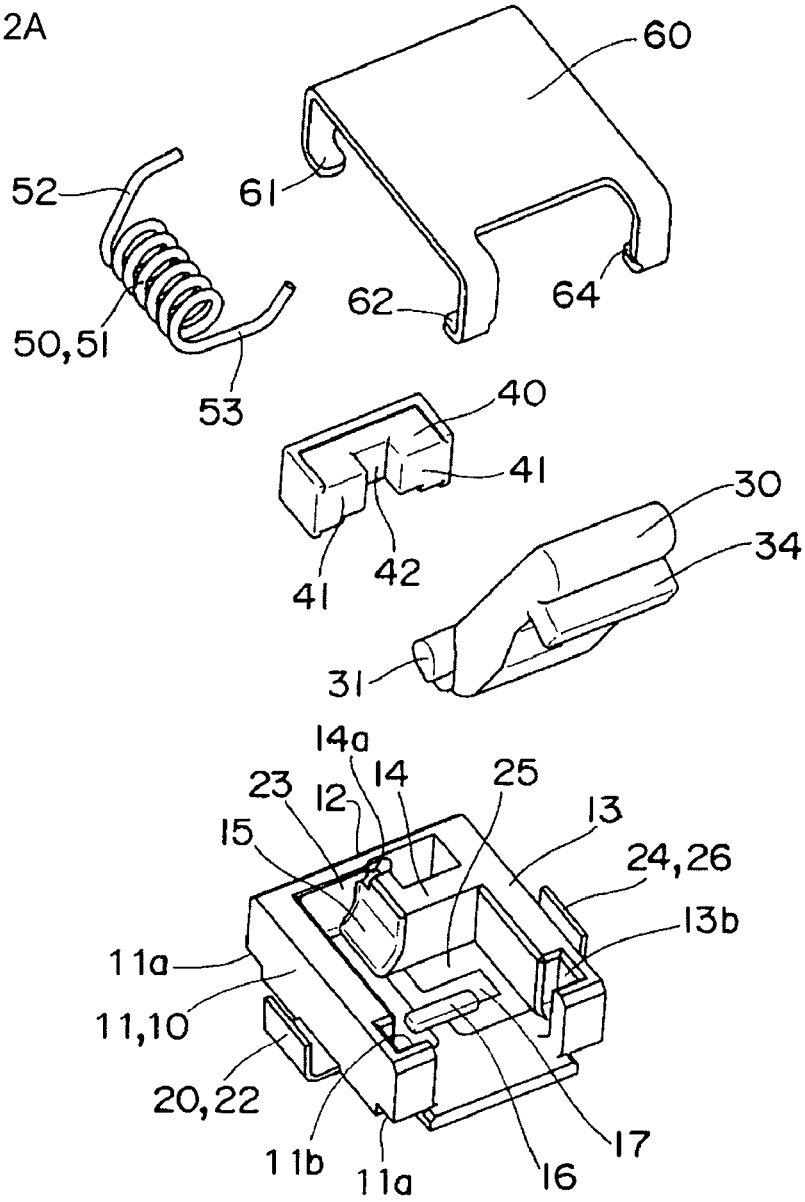
FIG. 12A shows an exploded perspective view of the switch shown in FIG. 11A.
Figure 12B:
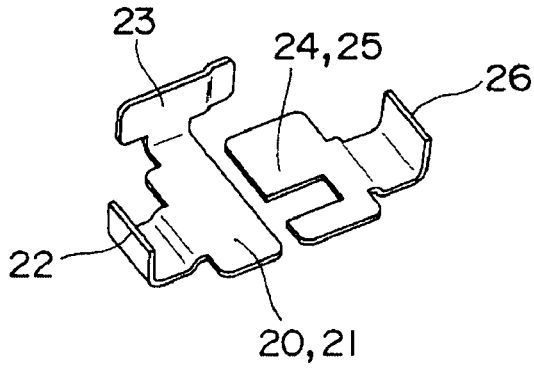
FIG. 12B shows a perspective view showing only the terminals of the base shown in FIG. 12A.
Figure 13A:
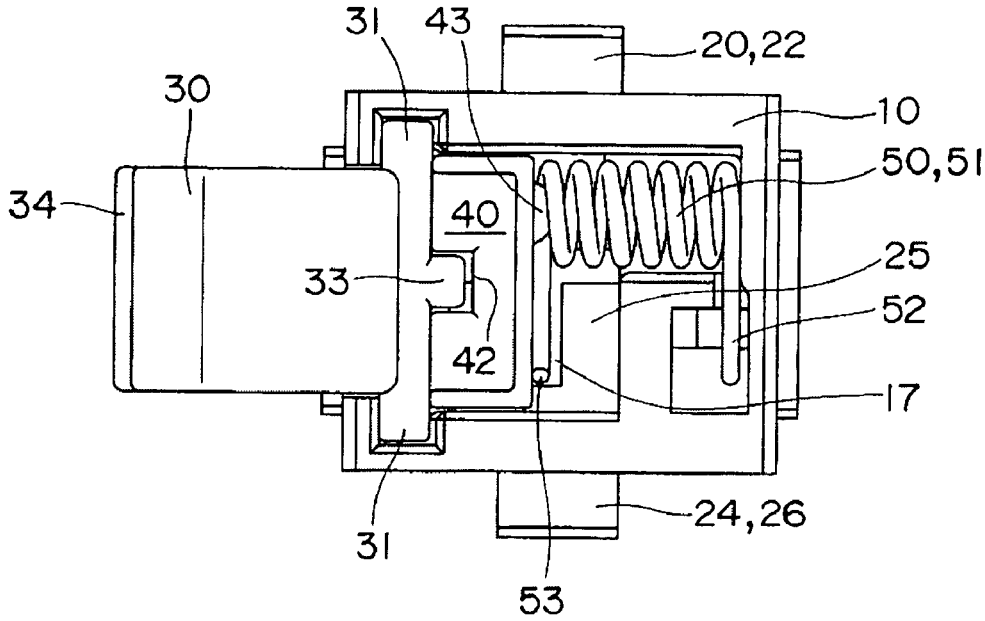
FIGS. 13A and 13B respectively show a plan view of before the operation in which the cover is detached, and a cross sectional view of before the operation in which the cover is attached.
Figure 13B:
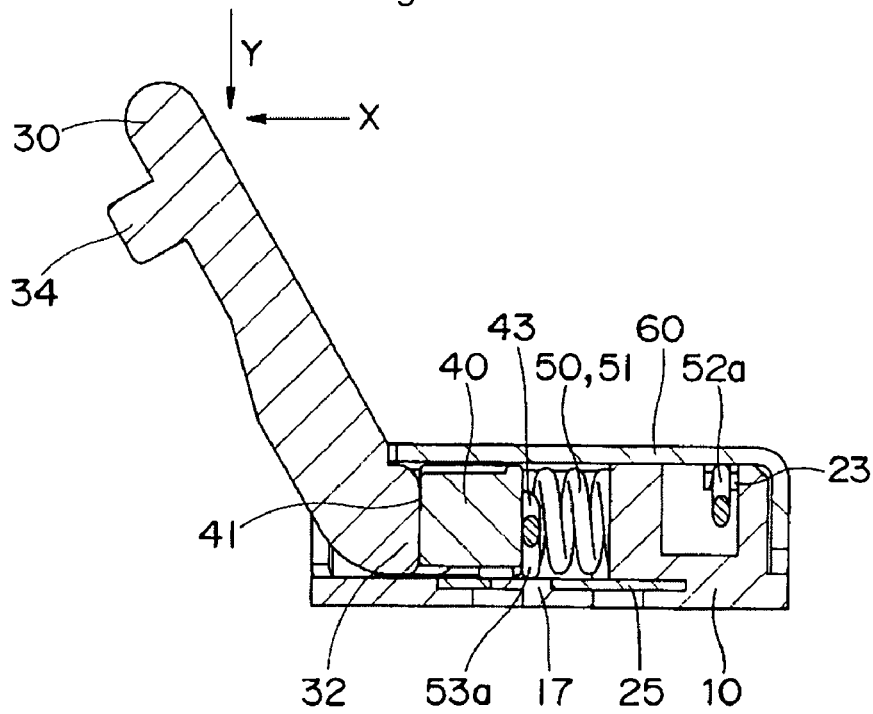
Figure 14A:
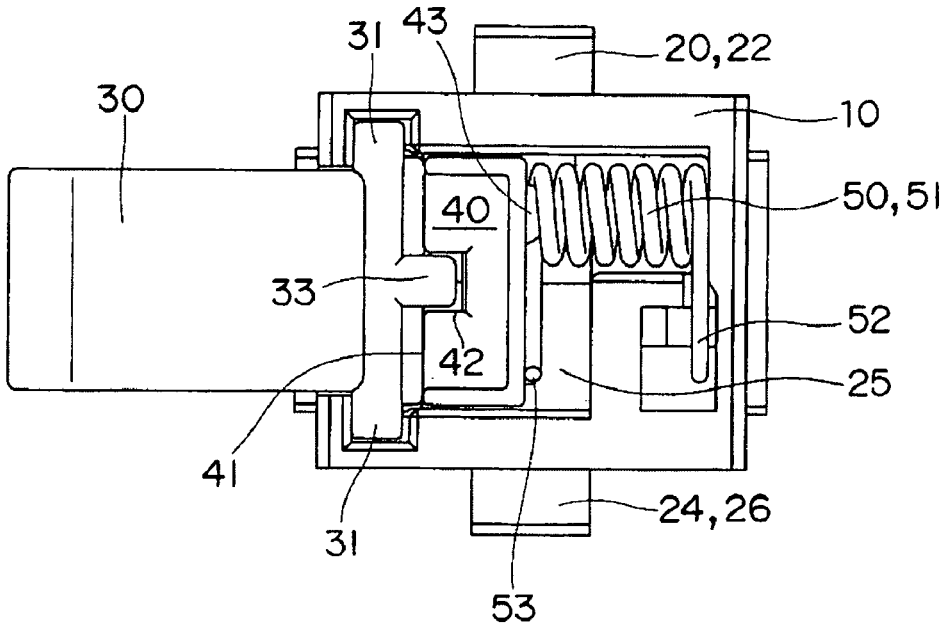
FIGS. 14A and 14B respectively show a plan view in middle of the operation in which the cover is detached, and a cross sectional view in middle of the operation in which the cover is attached.
Figure 14B:
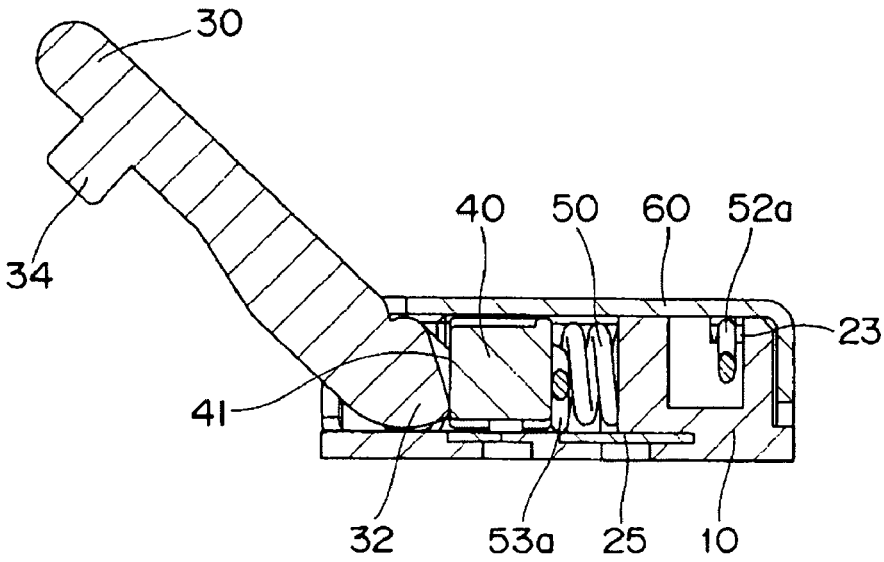
Figure 15A:
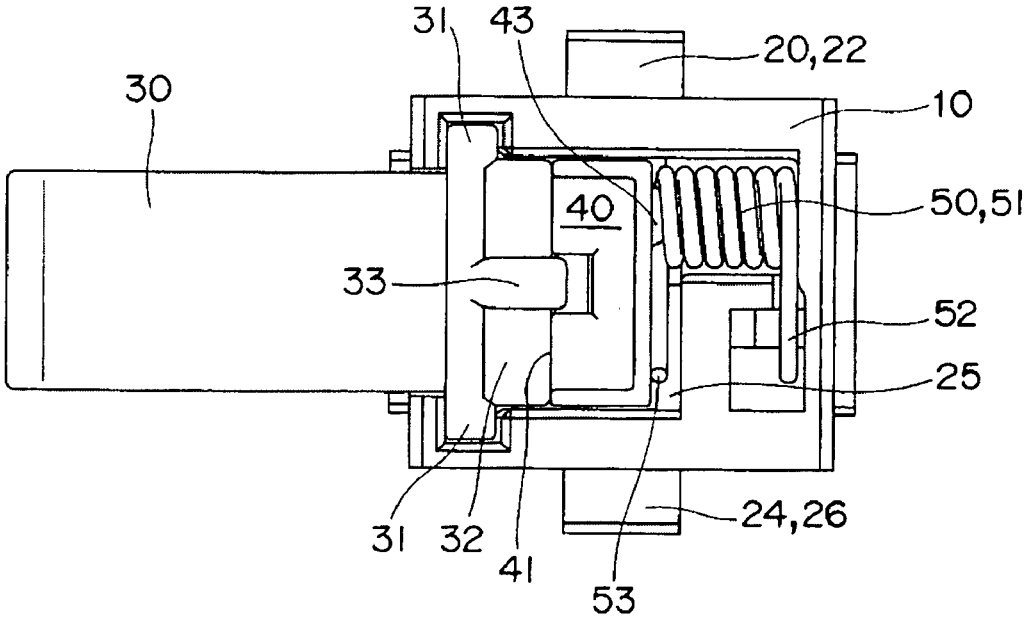
FIGS. 15A and 15B respectively show a plan view of after the operation in which the cover is detached, and a cross sectional view of after the operation in which the cover is attached.
Figure 15B:
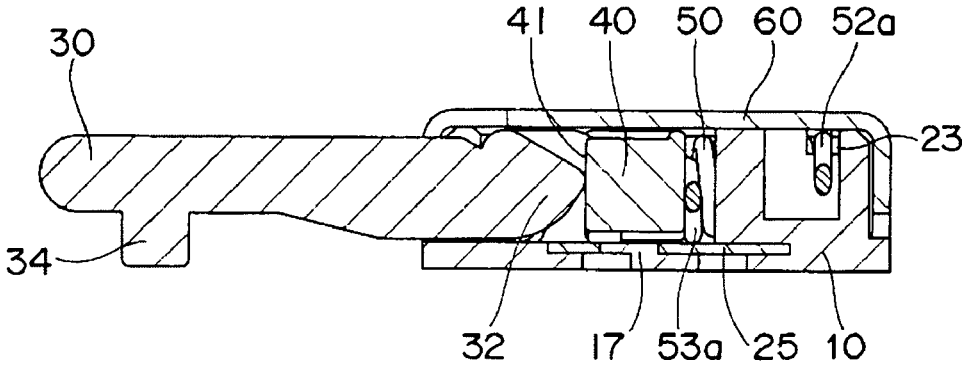

Furthermore, when the operation lever 30 is pushed in, the contacting point part 53*a* of the arm part 53 slides on the fixed contact point 25, and the fixed contact point terminals 20, 24 maintain the conduction state, as shown in FIG. 10. When the operation lever 30 is further pushed in, the projection 34 of the operation lever 30 contacts the floor surface, and the operation lever 30 stops.

When the load is thereafter released, the operation lever 30 is pushed back by way of the slider 40 by the spring force of the coil spring 50, and the contacting point part 53*a* of the coil spring 50 opens and separates from the fixed contact point 25 and contacts the insulation part 17, whereby the fixed contact point terminals 20, 24 become non-electrically conductive.

The basic configuration of the third embodiment according to the present invention is substantially the same as the above embodiments, as shown in FIGS. 11 to 15, but differs in that the coil spring 50 is not arranged at the center of the base 10 but is arranged at the corner. According to the present embodiment, the space efficiency enhances, in particular, a switch having a smaller width dimension is obtained compared to the above examples. Other configurations are substantially the same as the above described embodiments, and thus same reference numbers are denoted for the same components, and the description thereof will be omitted.

The fourth embodiment is basically the same as the third embodiment, but differs in that application is made to a switch having an always-closed contacting point, as shown in FIGS. 16 to 19.

Figure 16A:
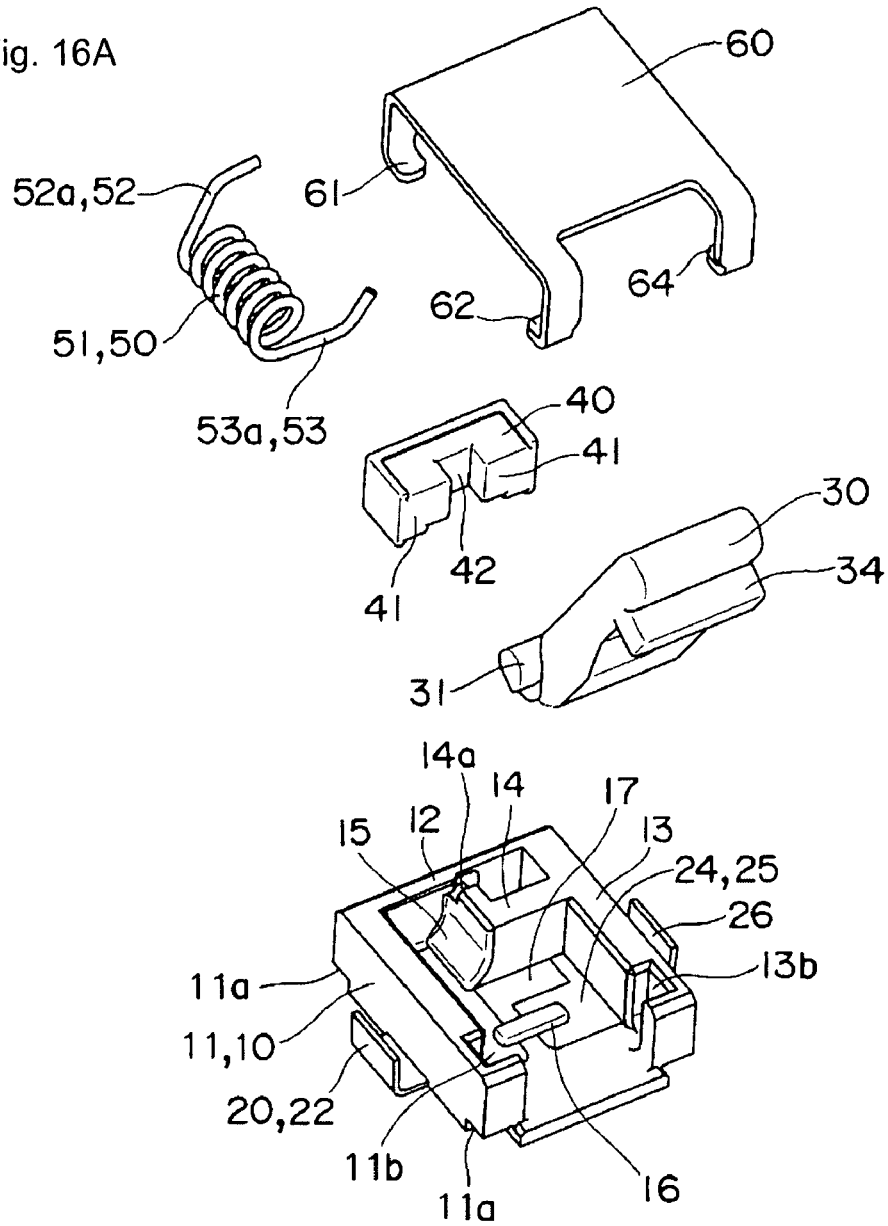
FIG. 16A shows an exploded perspective view of a switch according to a fourth embodiment.
Figure 16B:
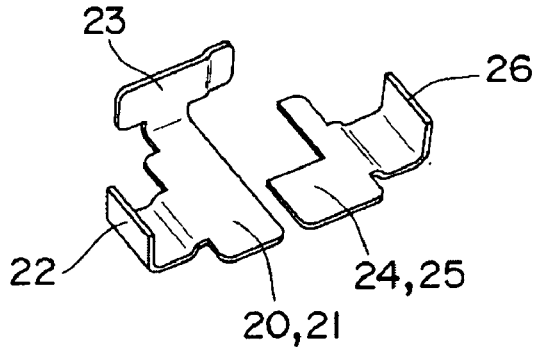
FIG. 16B shows a perspective view showing only the terminals of the base shown in FIG. 16A.

That is, the switching fixed contact point 25 of the switching fixed contact point terminal 24 is exposed from the inner bottom surface of the base 10, and is regulated from floating by the float-preventing projection 16, as shown in FIG. 16. The insulation part 17 is arranged on the switching fixed contact point 25 so as to be adjacent thereto. Thus, the coil spring 50 is compressed and accommodated in the accommodating groove 15 of the base 10, and the contacting point part 53*a* of the arm part 53 contacts the switching fixed contact point 25 with a predetermined contact force. The second common fixed contact point 23 and the switching fixed contact point 25 are thereby short circuited by way of the coil spring 50, and the fixed contact point terminals 20, 24 become electrically conductive.

Figure 17A:
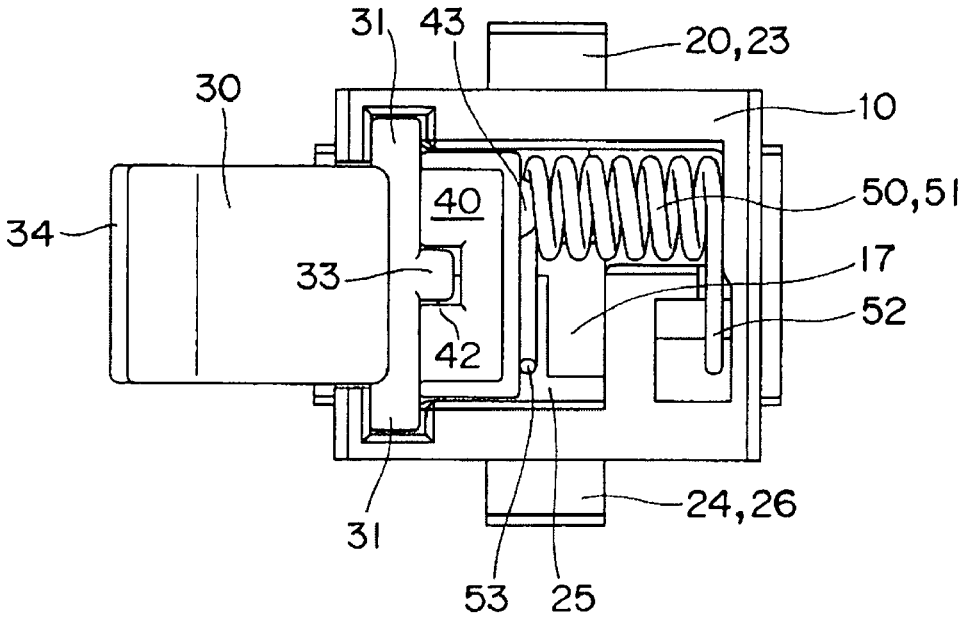
FIGS. 17A and 17B respectively show a plan view of before the operation in which the cover is detached, and a cross sectional view of before the operation in which the cover is attached.
Figure 17B:
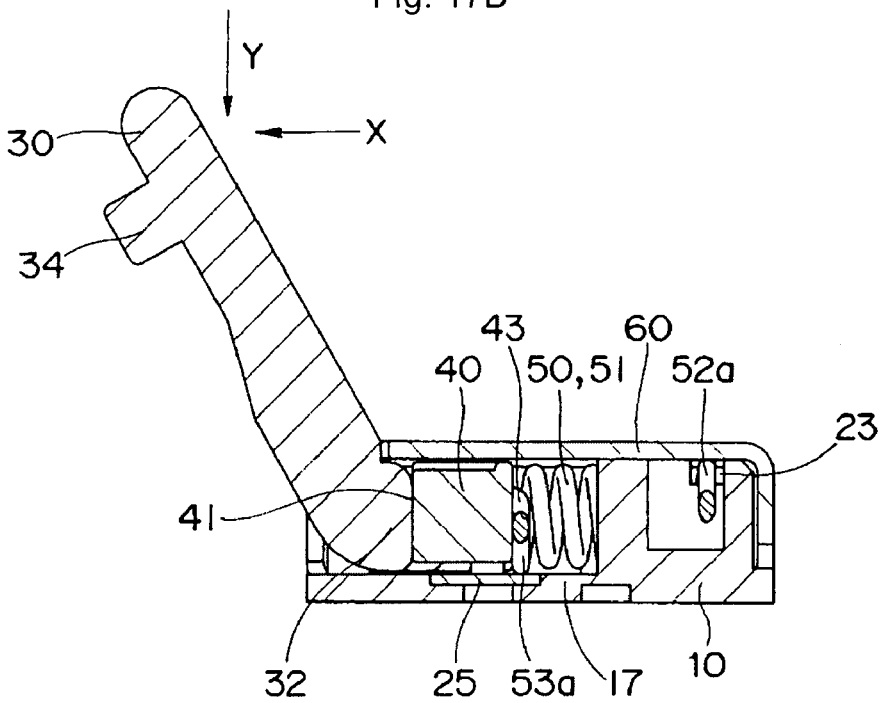
Figure 18A:
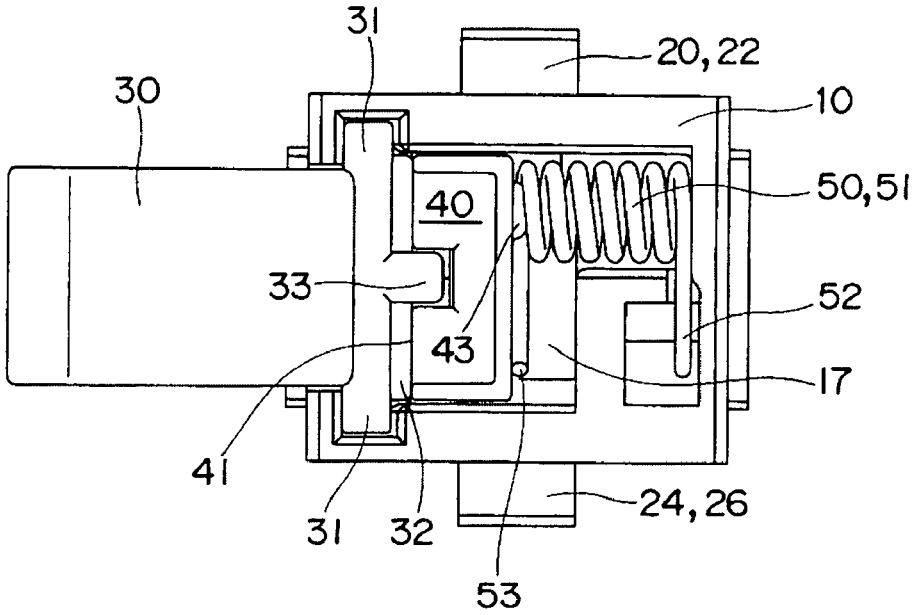
FIGS. 18A and 18B respectively show a plan view in middle of the operation in which the cover is detached, and a cross sectional view in middle of the operation in which the cover is attached.
Figure 18B:
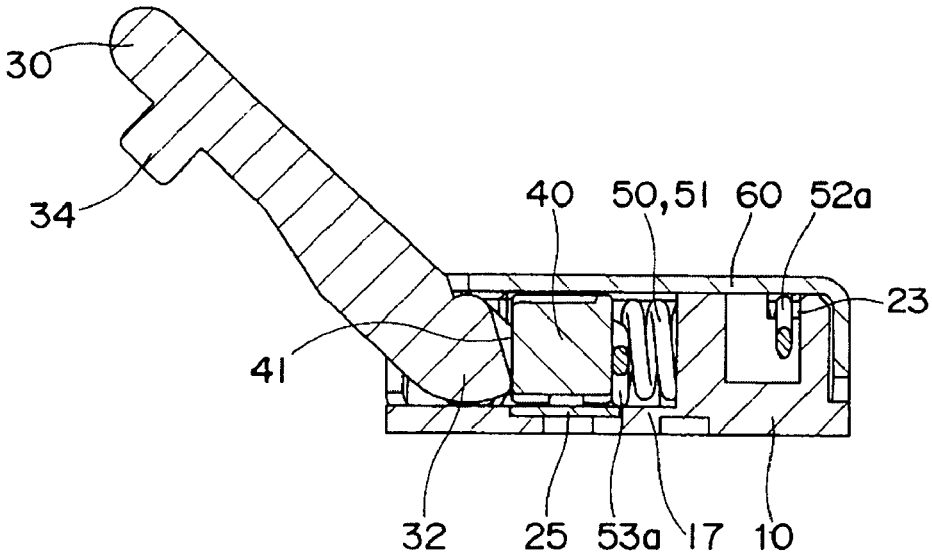

As shown in FIG. 17, when external force is loaded to the operation lever 30 in the direction of the arrow X or Y, the operation lever 30 pivots with the shaft part 31 as the center against the spring force of the coil spring 50. The cam part 32 of the operation lever 30 then pushes the pressure receiving surface 41 of the slider 40 and the slider 40 slides on the base 10, thereby compressing the coil part 51 of the coil spring 50. The contacting point 53*a* of the coil spring 50 thus slides on the switching fixed contact point 25 and contacts the insulation part 17, as shown in FIG. 18. Thus, the fixed contact point terminals 20, 24 become non-electrically conductive.

Figure 19A:
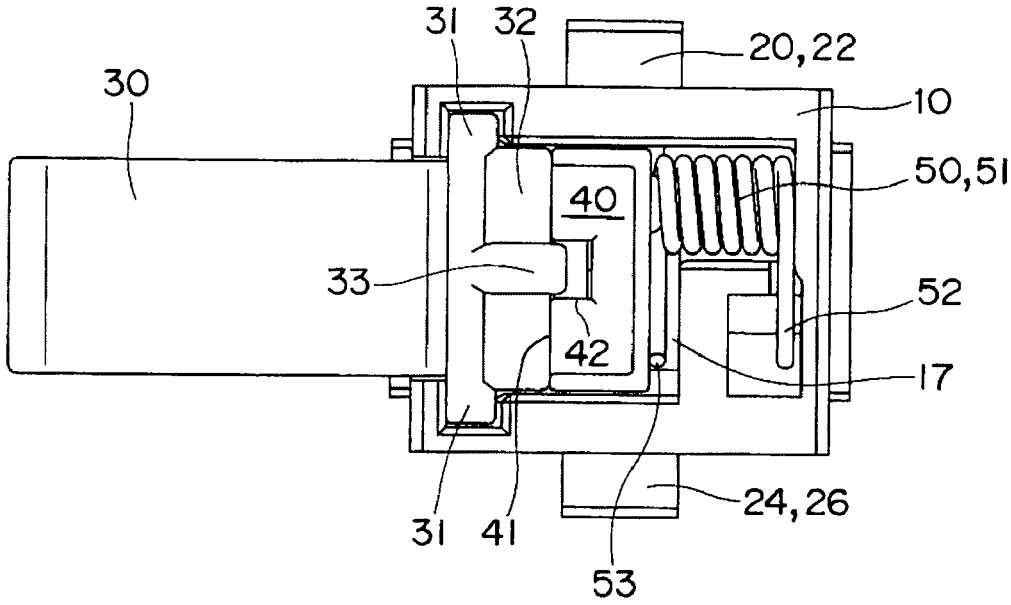
FIGS. 19A and 19B respectively show a plan view of after the operation in which the cover is detached, and a cross sectional view of after the operation in which the cover is attached.
Figure 19B:
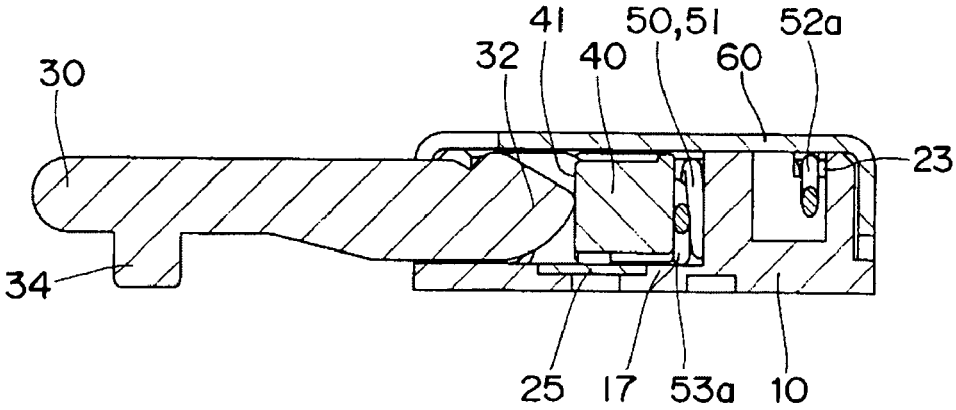
Figure 20A:
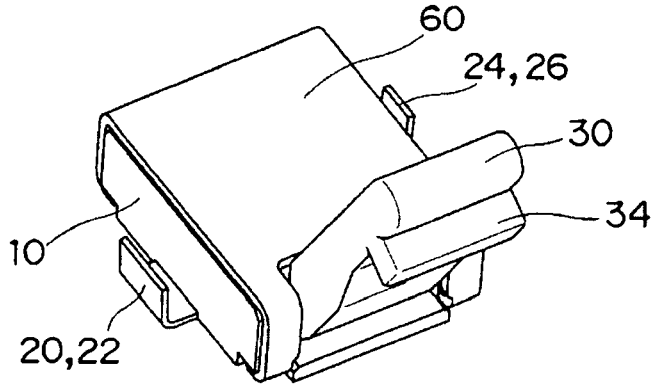
FIG. 20A, and FIGS. 20B and 20C respectively show a perspective view of a fifth embodiment of a switch according to the present invention, and perspective views of before and after the operation in which the cover is detached.
Figure 20B:
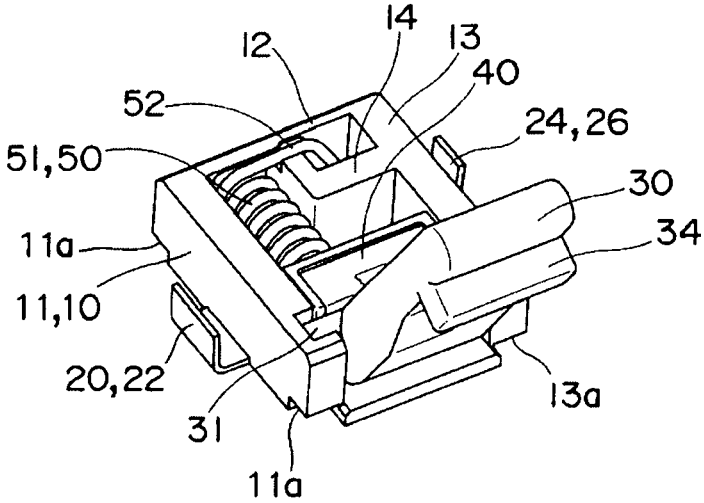
Figure 20C:
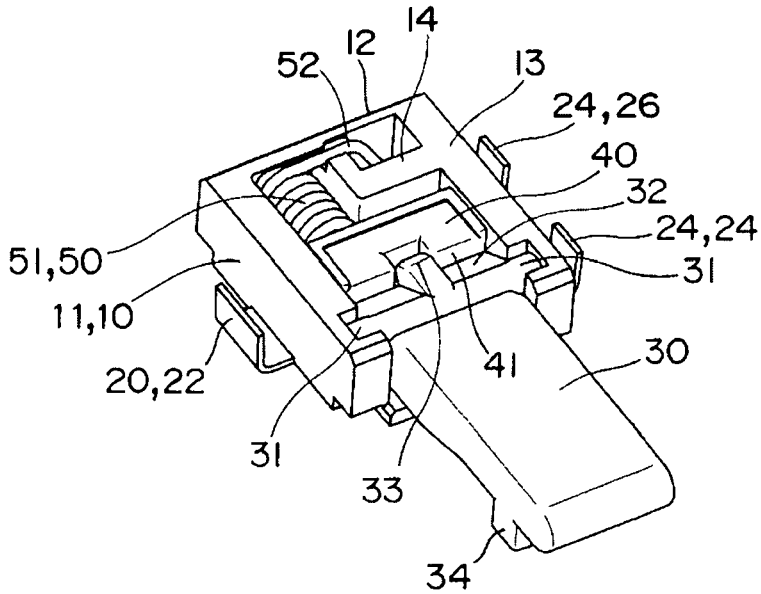

Furthermore, when the operation lever 30 is pushed in, the contacting point part 53*a* of the arm part 53 slides on the fixed contact point 25, and the fixed contact point terminals 20, 24 maintain the non-conduction state. When the operation lever 30 is further pushed in, the projection 34 of the operation lever 30 contacts the floor surface, and the operation lever 30 stops, as shown in FIG. 19.

When the above load is thereafter released, the operation lever 30 is pushed back by way of the slider 40 by the spring force of the coil spring 50, and the contacting point part 53*a* of the coil spring 50 opens and separates from the insulation part 17 and contacts the fixed contact point 25, whereby fixed contact point terminals 20, 24 become electrically conductive.

The fifth embodiment is substantially the same as the fourth embodiment, as shown in FIGS. 20 to 25, but differs in that application is made to a switch for switching two types of circuits.

Figure 21A:
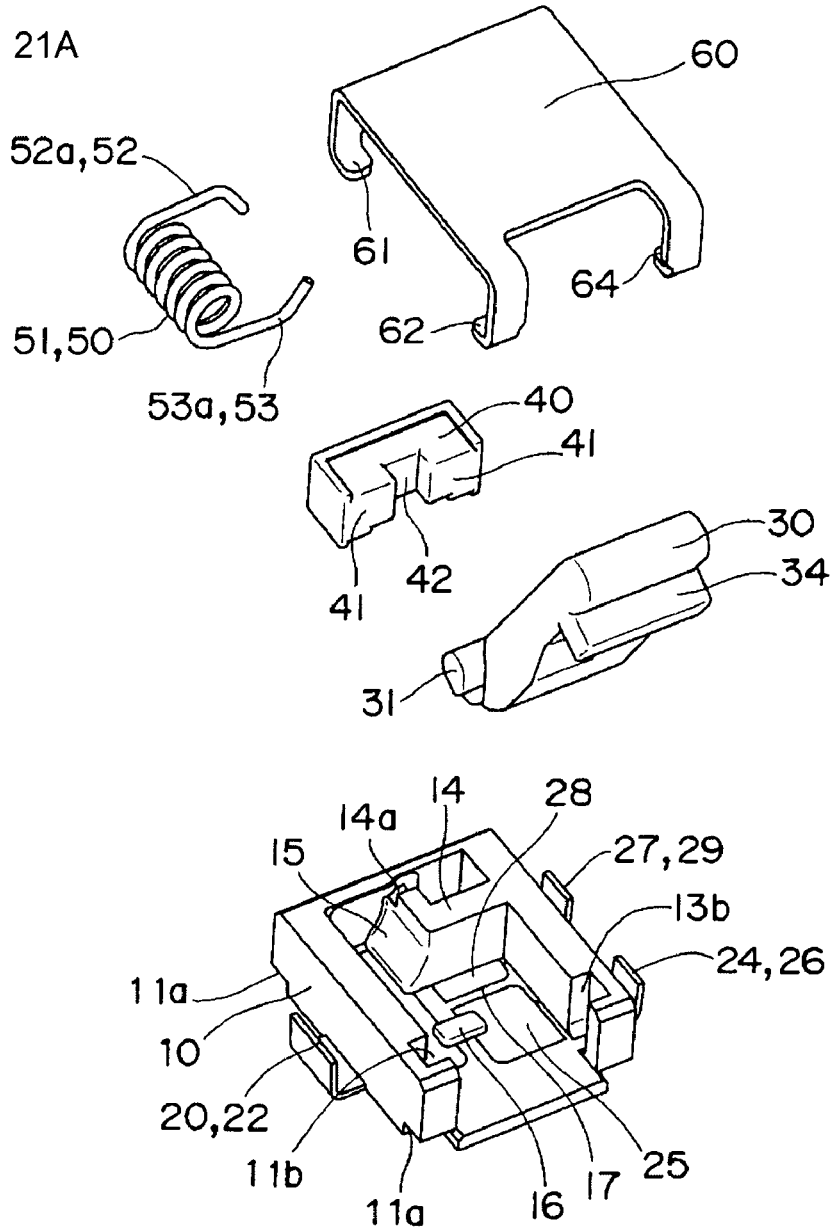
FIG. 21A shows an exploded perspective view of the switch shown in FIG. 20A.
Figure 21B:
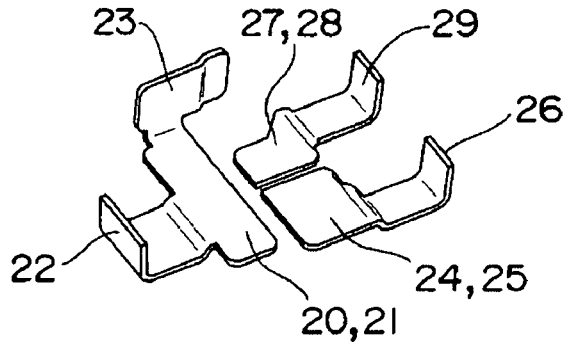
FIG. 21B shows a perspective view showing only the terminals of the base shown in FIG. 20A.

In the present embodiment, the common fixed contact point terminal 20 and a pair of switching fixed contact points 24, 27 are insert molded to the base 10, as shown in FIG. 21. Thus, the switching fixed contact points 25, 28 of the switching fixed contact point terminals 24, 27 are exposed with the insulation part 17 in between at the inner bottom surface of the base 10. Thus, the contacting point part 53*a* of the arm part 53 contacts the switching fixed contact point 25 with a predetermined contact force and contacts and separates from the switching fixed contact point 28 by compressing and accommodating the coil spring 50 in the accommodating groove 15 of the base 10. Reference number 29 is the terminal part of the switching fixed contact point terminal 27.

Figure 22A:
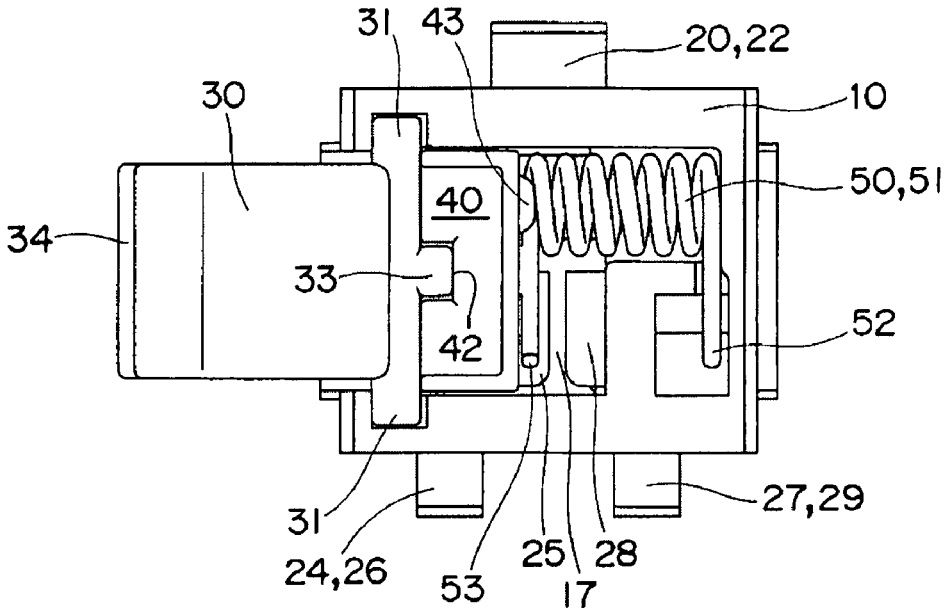
FIGS. 22A and 22B respectively show a plan view of before the operation in which the cover is detached, and a cross sectional view of before the operation in which the cover is attached.
Figure 22B:
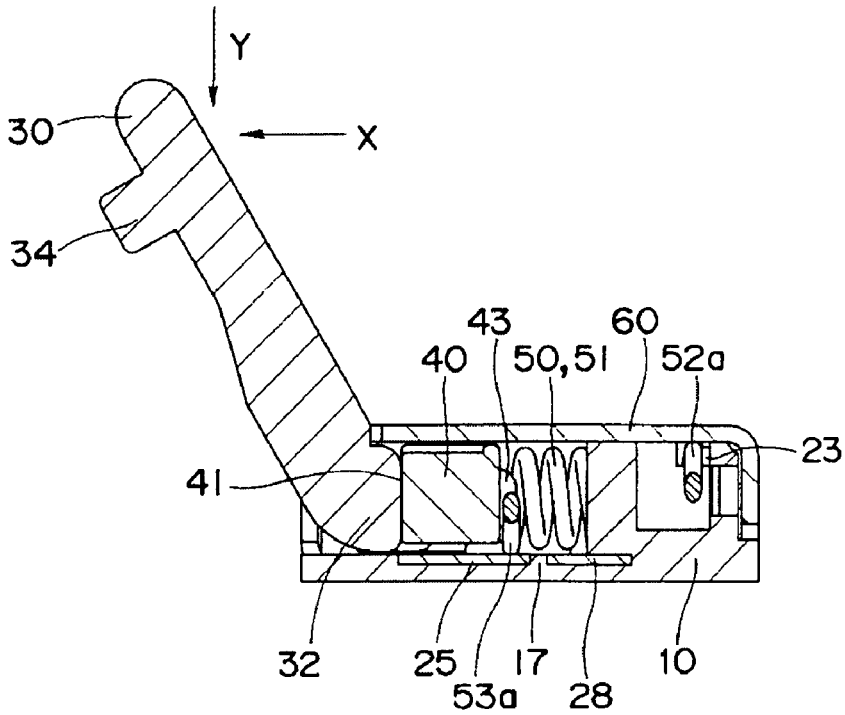
Figure 23A:
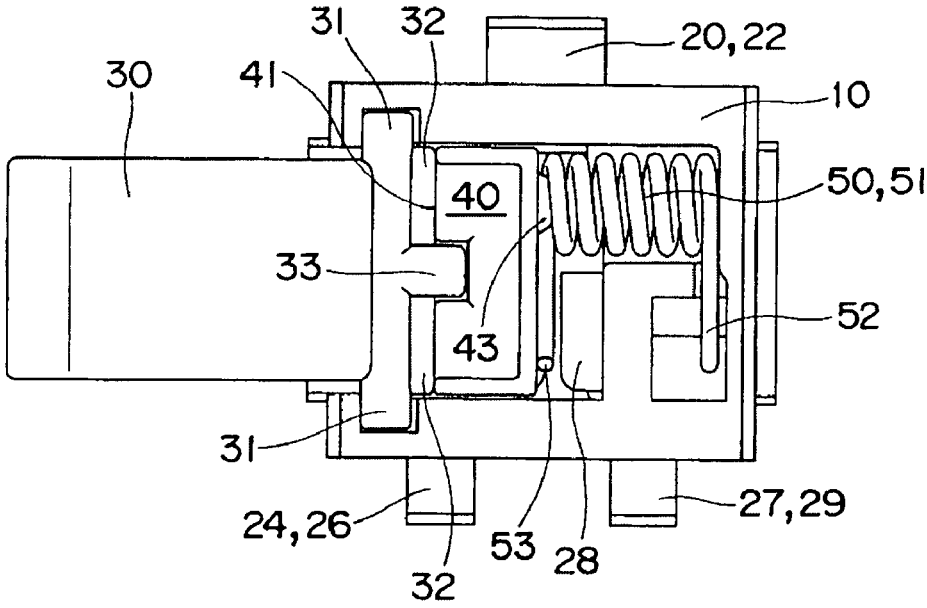
FIGS. 23A and 23B respectively show a plan view in middle of the operation in which the cover is detached, and a cross sectional view in middle of the operation in which the cover is attached.
Figure 23B:
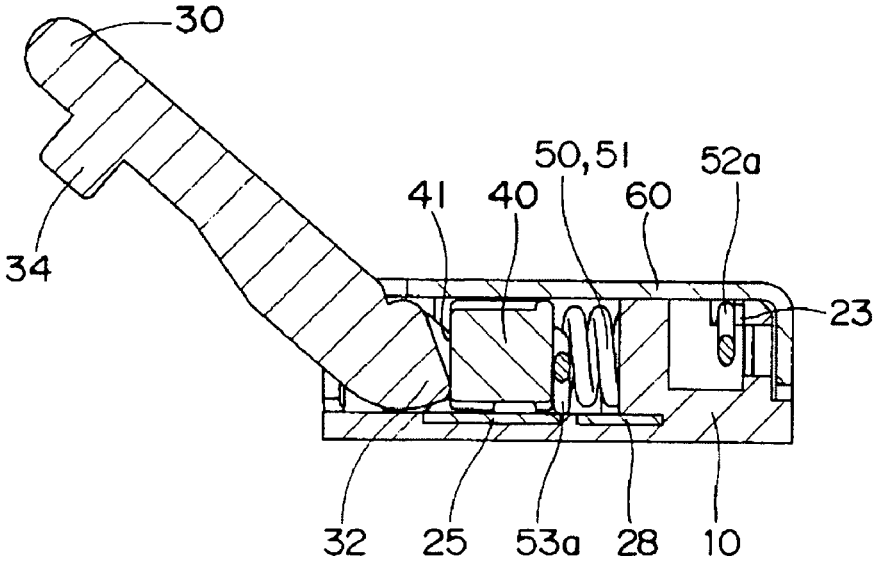

As shown in FIG. 22, when external force is loaded to the operation lever 30 in the direction of the arrow X or Y, the operation lever 30 pivots with the shaft part 31 as the center against the spring force of the coil spring 50. The cam part 32 of the operation lever 30 then pushes the pressure receiving surface 41 of the slider 40 and the slider 40 slides on the base 10, thereby compressing the coil part 51 of the coil spring 50. The contacting point 53*a* of the coil spring 50 thus slides on the switching fixed contact point 25 of the base 10, passes the insulation part 17 and contacts the switching fixed contact point 28, as shown in FIG. 23. Thus, the second common fixed contact point 23 and the switching fixed contact point 28 are short circuited by way of the coil spring 50, and the fixed contact point terminals 20, 27 become electrically conductive.

Figure 24A:
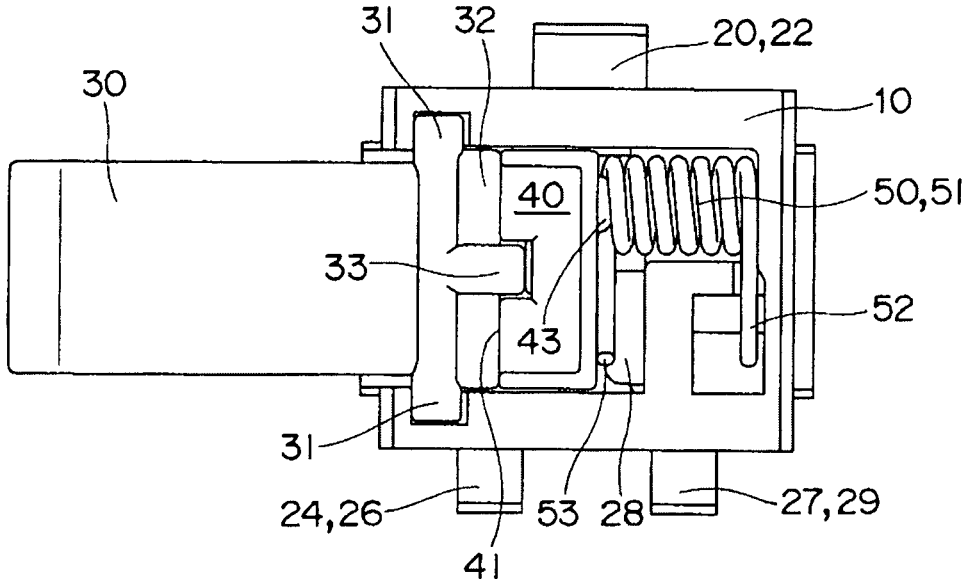
FIGS. 24A and 24B respectively show a plan view in middle of the operation in which the cover is detached, and a cross sectional view in middle of the operation in which the cover is attached.
Figure 24B:
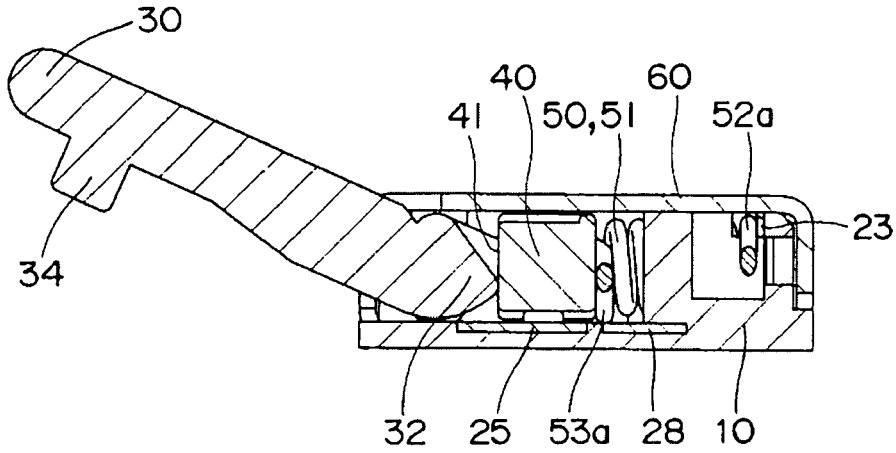
Figure 25A:
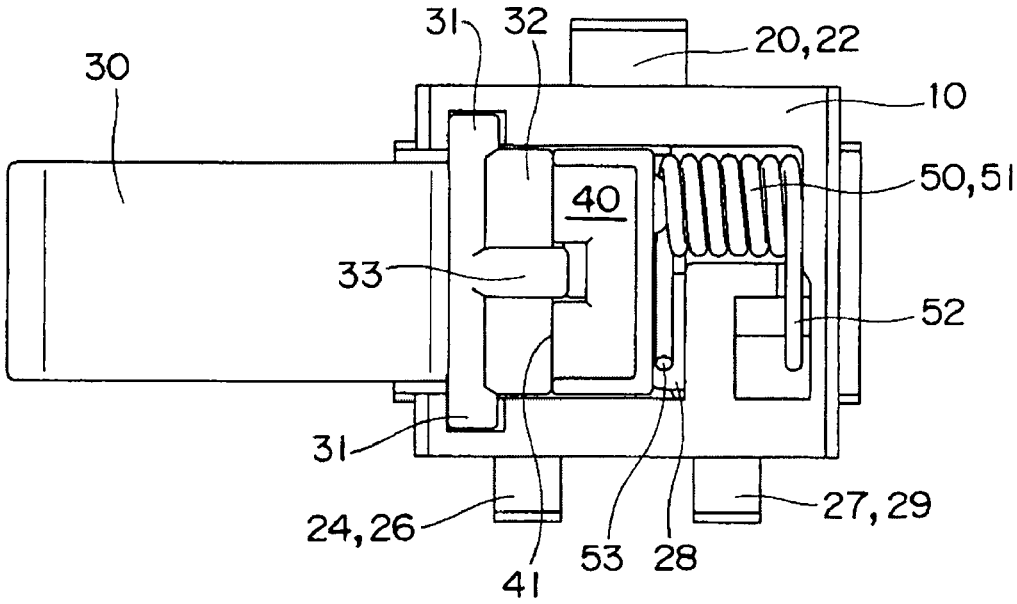
FIGS. 25A and 25B respectively show a plan view of after the operation in which the cover is detached, and a cross sectional view of after the operation in which the cover is attached.
Figure 25B:
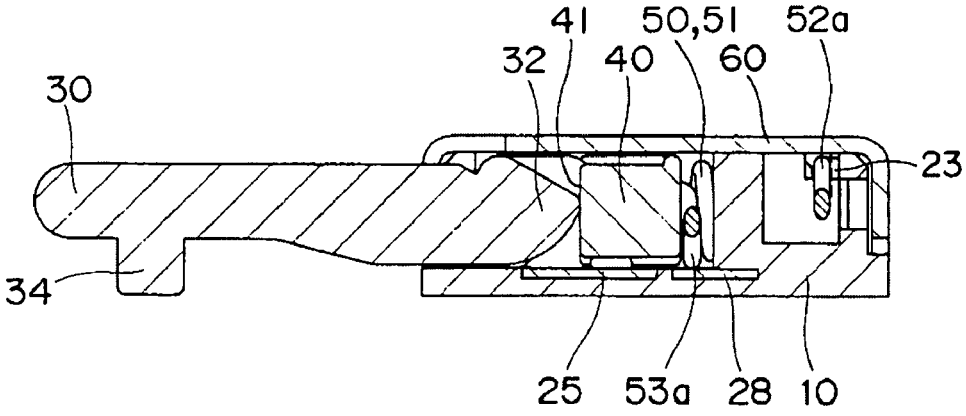
Figure 26A:
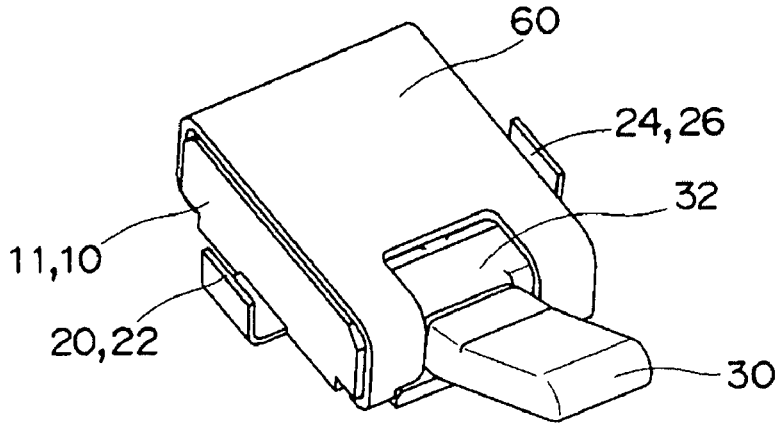
FIG. 26A, and FIGS. 26B and 26C respectively show a perspective view of a sixth embodiment of a switch according to the present invention, and perspective views of before and after the operation in which the cover is detached.
Figure 26B:
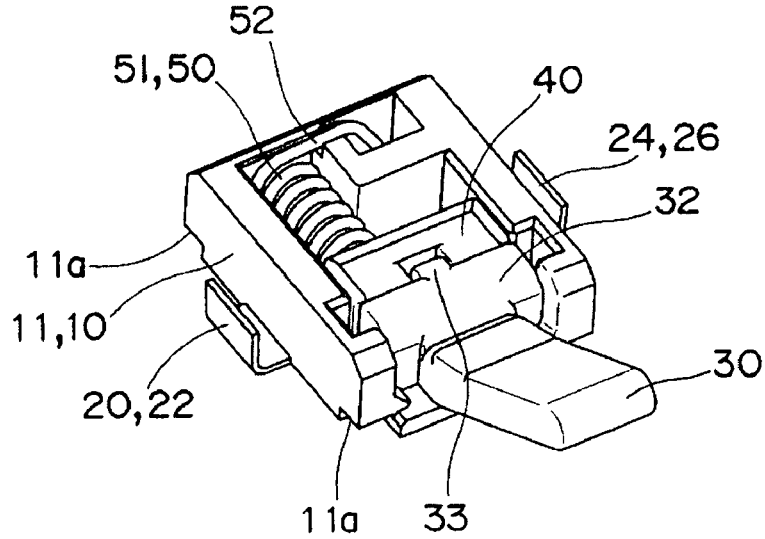
Figure 26C:
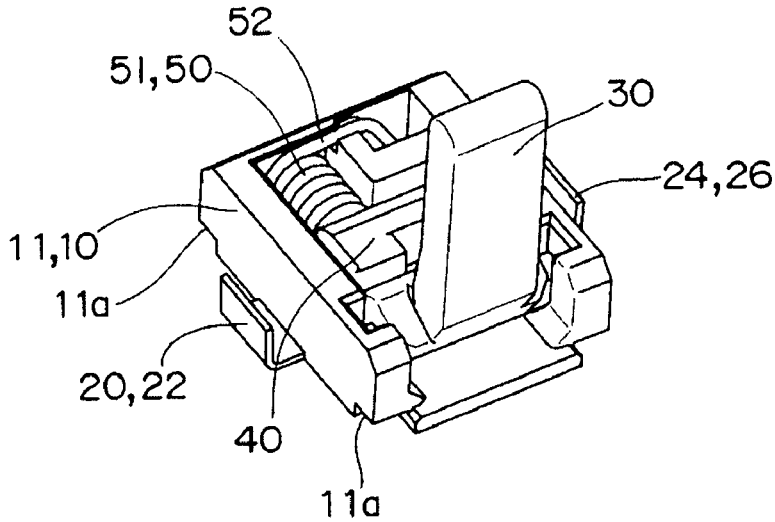
Figure 27A:
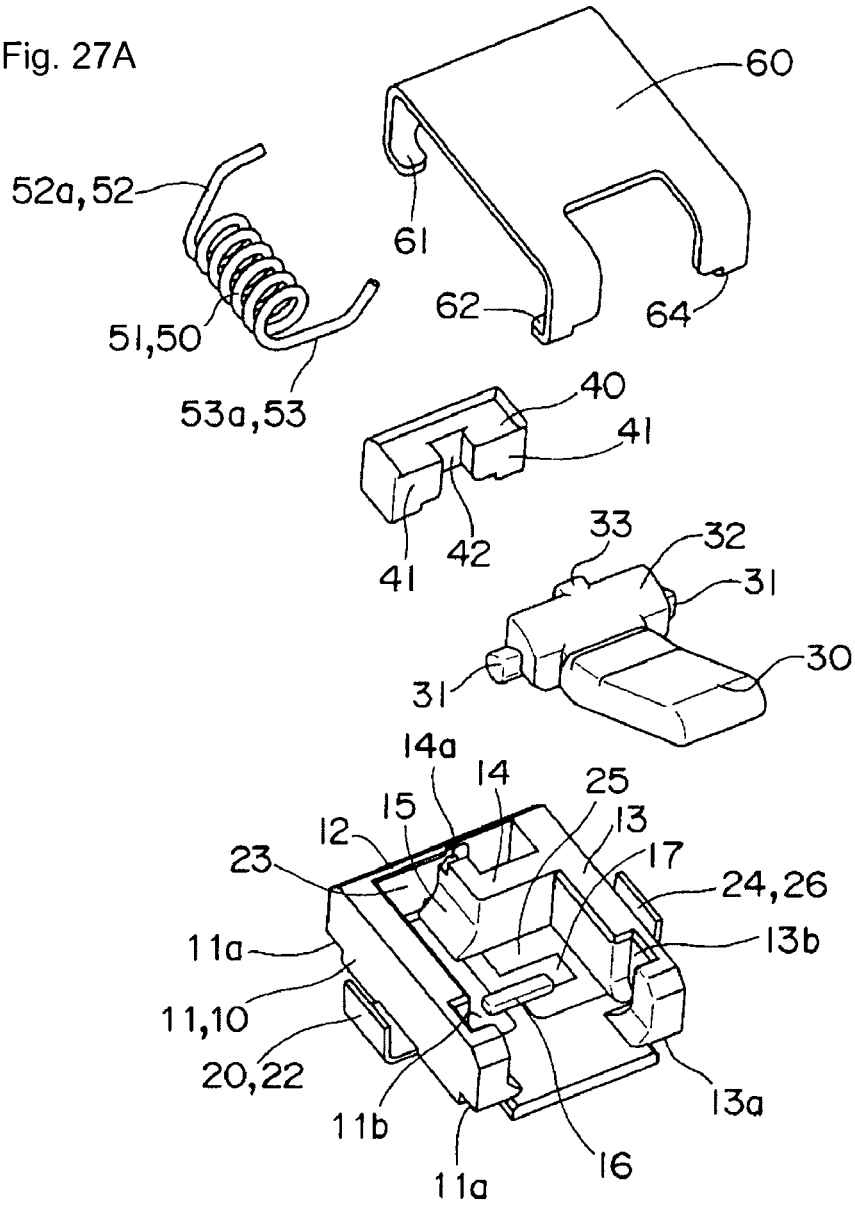
FIG. 27A shows an exploded perspective view of the switch shown in FIG. 26A.
Figure 27B:
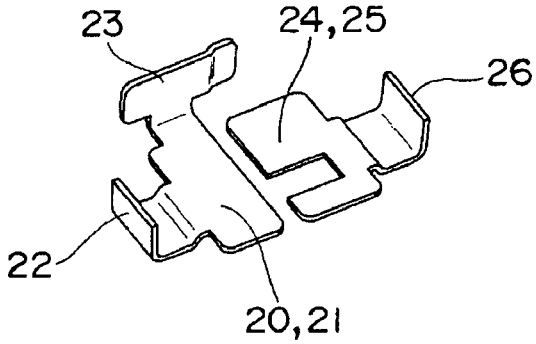
FIG. 27B shows a perspective view showing only the terminals of the base shown in FIG. 27A.

Furthermore, when the operation lever 30 is pushed in, the contacting point part 53*a* of the arm part slides on the fixed contact point 28, and the fixed contact point terminals 20, 27 maintain the non-conduction state, as shown in FIG. 24. When the operation lever 30 is further pushed in, the projection 34 of the operation lever 30 contacts the floor surface, and the operation lever 30 stops, as shown in FIG. 25.

When the above load is thereafter released, the operation lever 30 is pushed back by way of the slider 40 by the spring force of the coil spring 50, and the contacting point part 53*a* of the coil spring 50 opens and separates from the fixed contact point 28, passes through the insulation part 17 and contacts the fixed contact point 25, whereby the fixed contact point terminals 20, 24 become electrically conductive.

The sixth embodiment is basically the same as the third embodiment described above, as shown in FIGS. 26 to 30, but differs in the pivoting direction of the operation lever 30.

The operation lever 30 according to the present embodiment pivots so as to rise when external force is loaded upward from the downward direction, and thus a position regulating projection 34 is not arranged on the operation lever 30 as in the above embodiments.

Figure 28A:
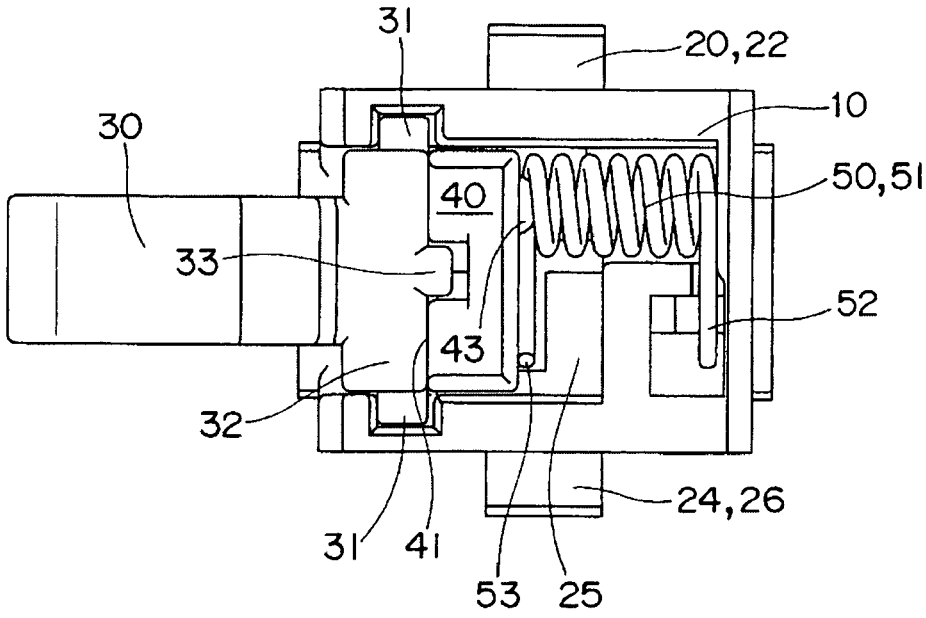
FIGS. 28A and 28B respectively show a plan view of before the operation in which the cover is detached, and a cross sectional view of before the operation in which the cover is attached.
Figure 28B:
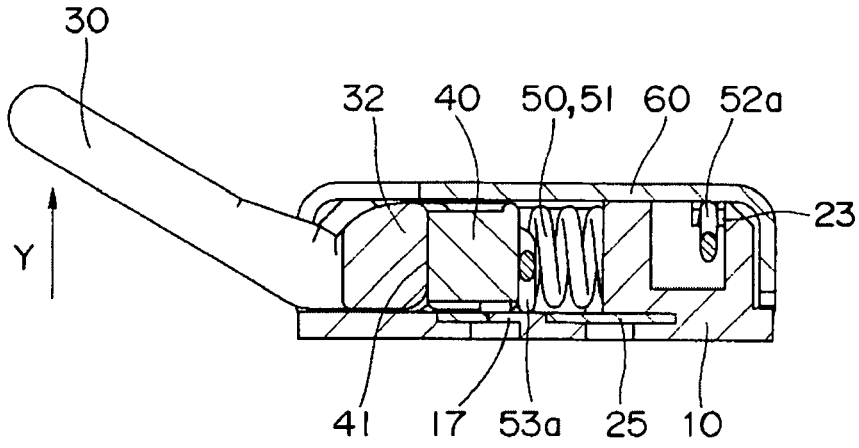
Figure 29A:
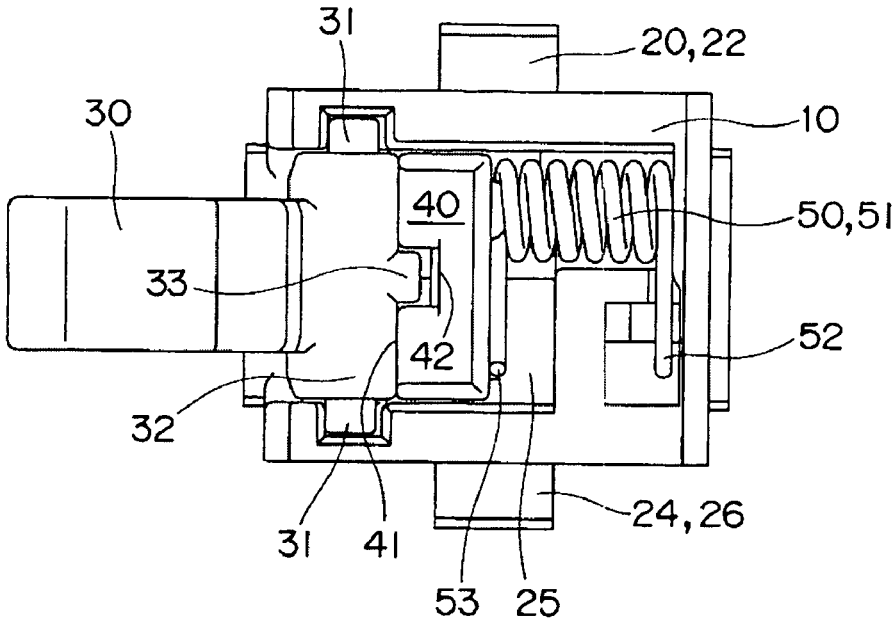
FIGS. 29A and 29B respectively show a plan view in middle of the operation in which the cover is detached, and a cross sectional view in middle of the operation in which the cover is attached.
Figure 29B:
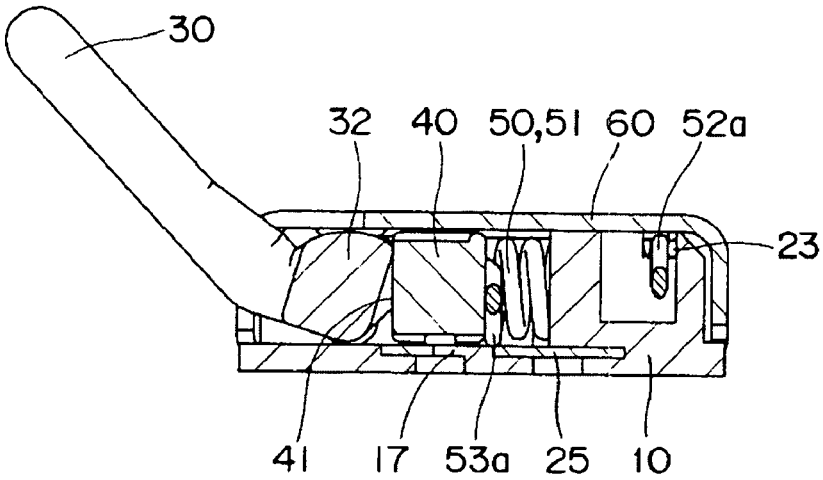

As shown in FIG. 28, when external force is loaded to the operation lever 30 in the direction of the arrow Y, the operation lever 30 pivots with the shaft part 31 as the center against the spring force of the coil spring 50. The cam part 32 of the operation lever 30 then pushes the pressure receiving surface 41 of the slider 40 and the slider 40 slides on the base 10, thereby compressing the coil part 51 of the coil spring 50. The contacting point 53*a* of the coil spring 50 thus slides on the insulation part 17 of the base 10, and contacts a switching fixed contact point 25, as shown in FIG. 29. The second common fixed contact point 23 and the switching fixed contact point 25 are thereby short circuited by way of the coil spring 50, and the fixed contact point terminals 20, 24 become electrically conductive.

Figure 30A:
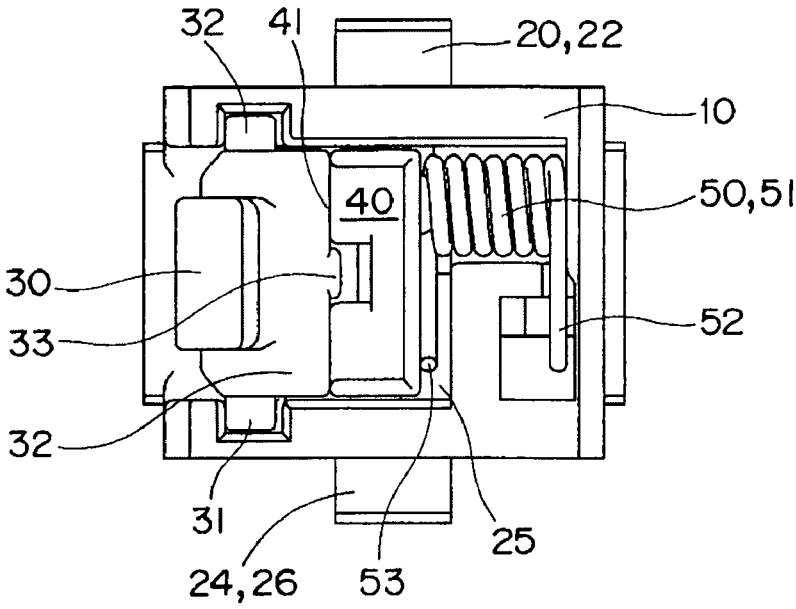
FIGS. 30A and 30B respectively show a plan view of after the operation in which the cover is detached, and a cross sectional view of after the operation in which the cover is attached.
Figure 30B:
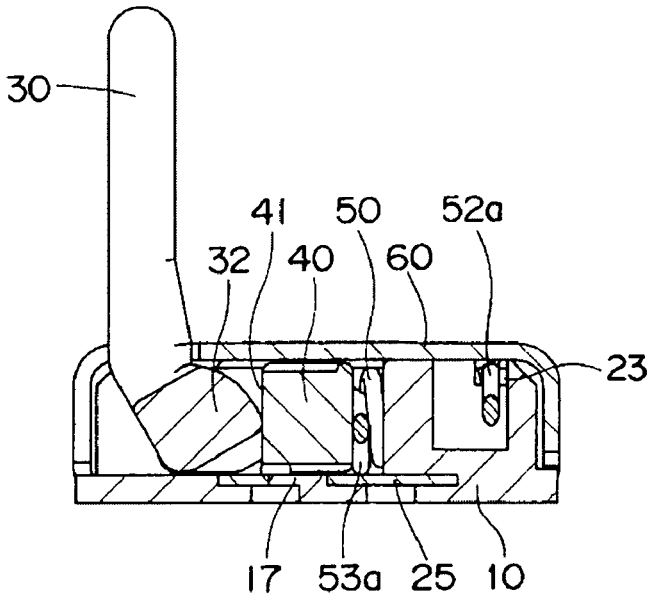
Figure 31A:
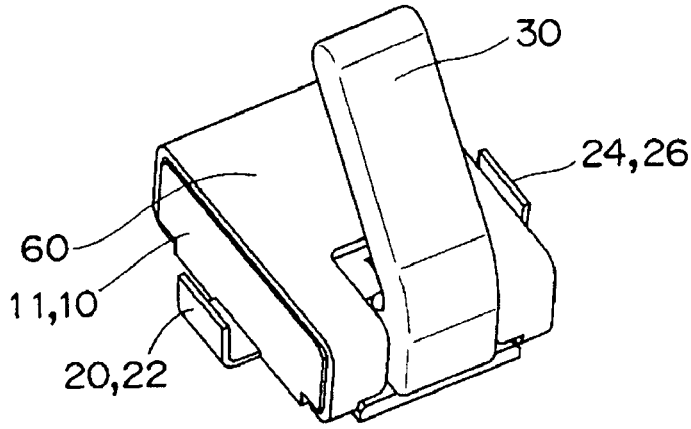
FIG. 31A, and FIGS. 31B and 31C respectively show a perspective view of a seventh embodiment of a switch according to the present invention, and perspective views of before and after the operation in which the cover is detached.
Figure 31B:
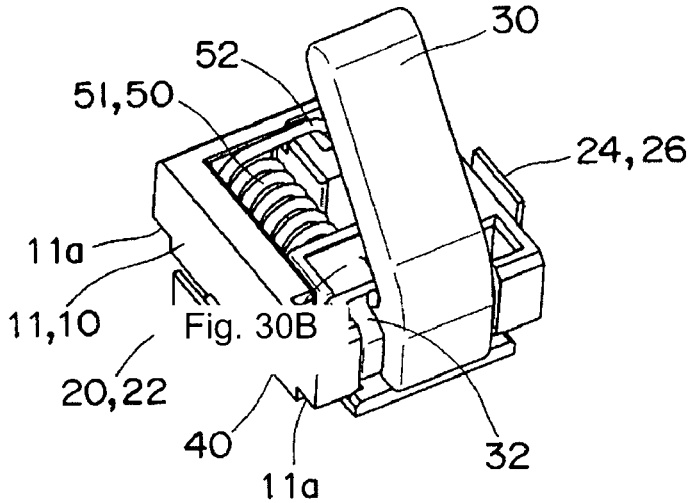
Figure 31C:
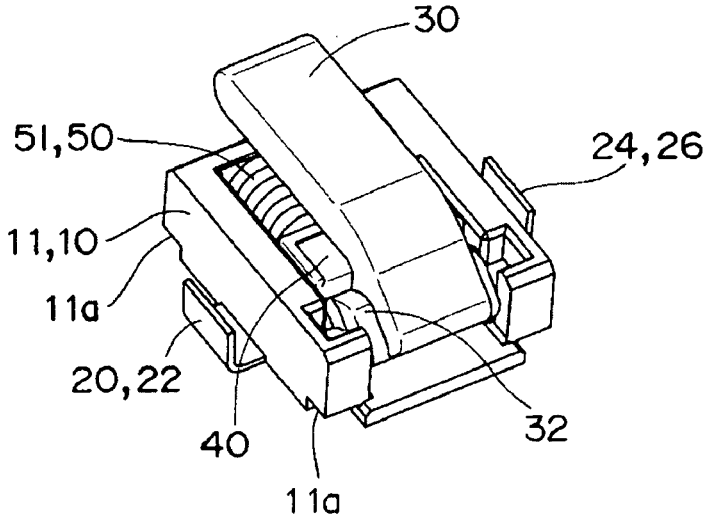
Figure 32A:
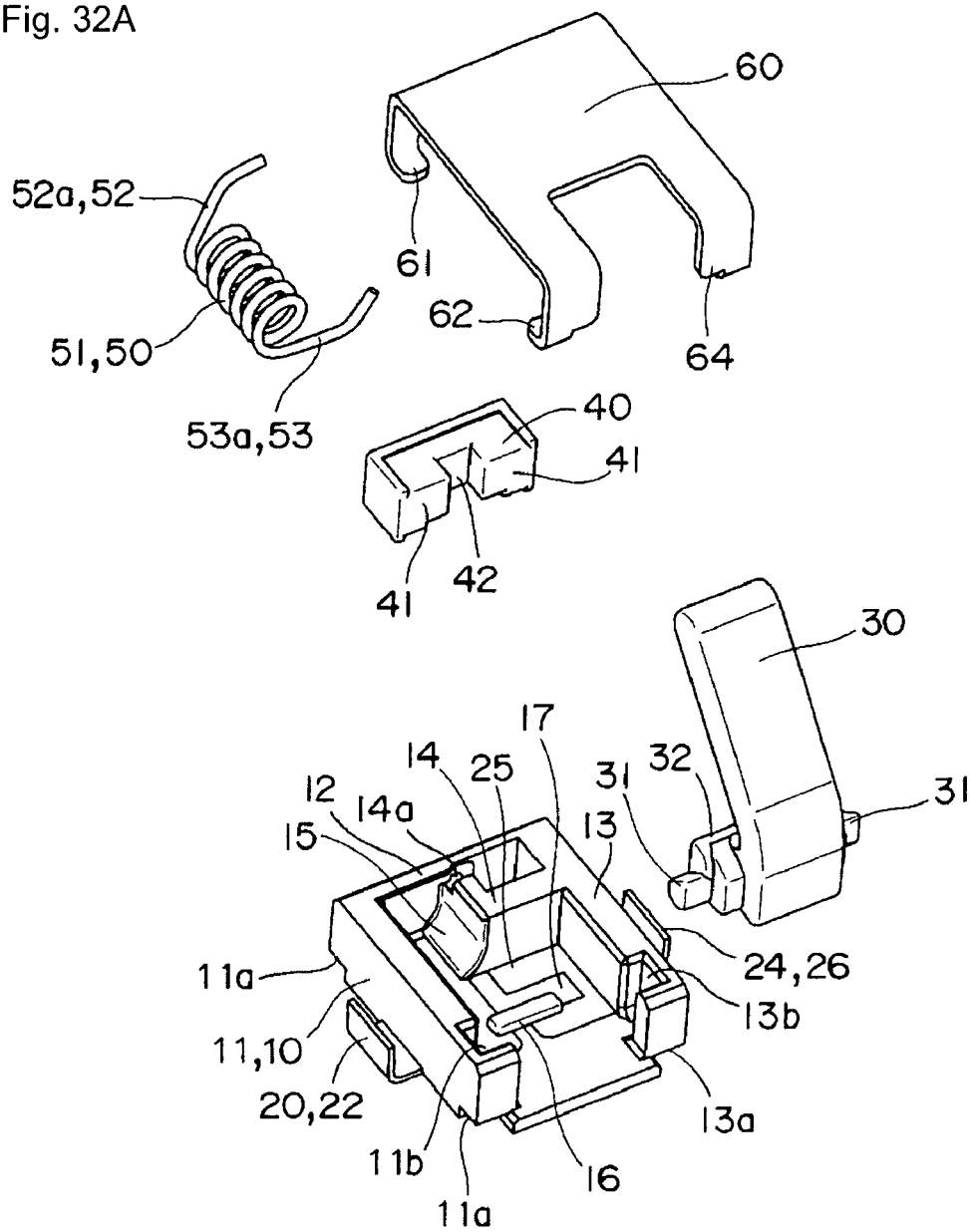
FIG. 32A shows an exploded perspective view of the switch shown in FIG. 30A.
Figure 32B:
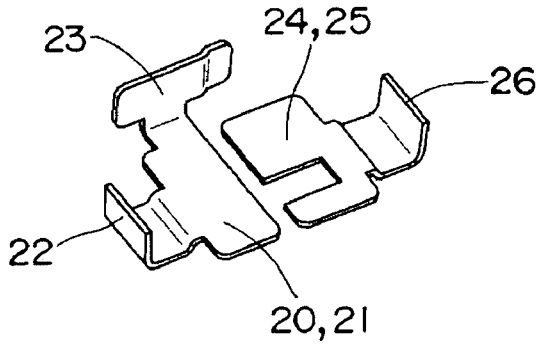
FIG. 32B shows a perspective view showing only the terminals of the base shown in FIG. 32A.

Furthermore, when the operation lever 30 is pushed up and stopped, the contacting point part 53*a* of the arm part 53 slides on the fixed contact point 25, and the fixed contact point terminals 20, 24 maintain the conduction state, as shown in FIG. 30.

When the load is thereafter released, the operation lever 30 is pushed back by way of the slider 40 by the spring force of the coil spring 50, and the contacting point part 53*a* of the coil spring 50 opens and separates from the fixed contact point 25 and contacts the insulation part 17, whereby the fixed contact point terminals 20, 24 become non-electrically conductive.

The seventh embodiment is basically the same as the sixth embodiment described above, as shown in FIGS. 31 to 35. The seventh embodiment differs from the sixth embodiment in that the operation lever 30 has a substantially L-shape, and the operation lever 30 is tilted to the switch main body side in the assembly completed state (free position of switch).

Figure 33A:
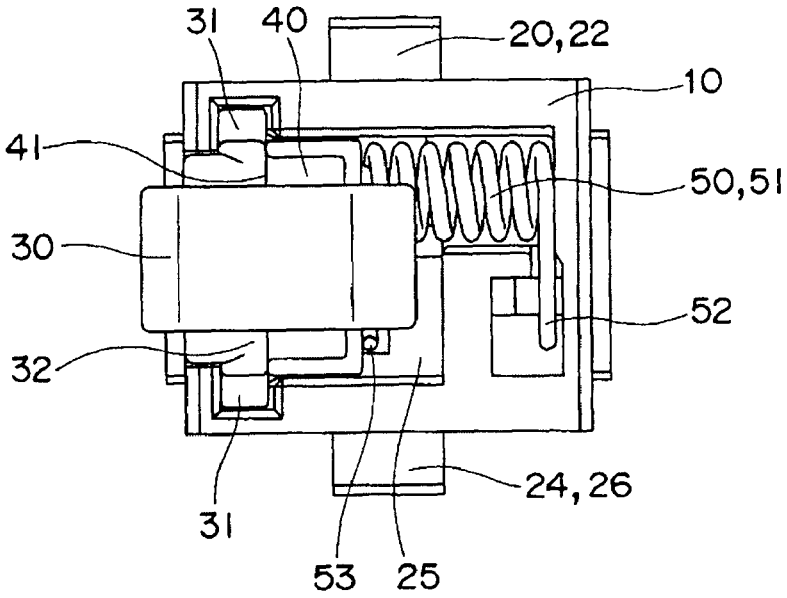
FIGS. 33A and 33B respectively show a plan view of before the operation in which the cover is detached, and a cross sectional view of before the operation in which the cover is attached.
Figure 33B:
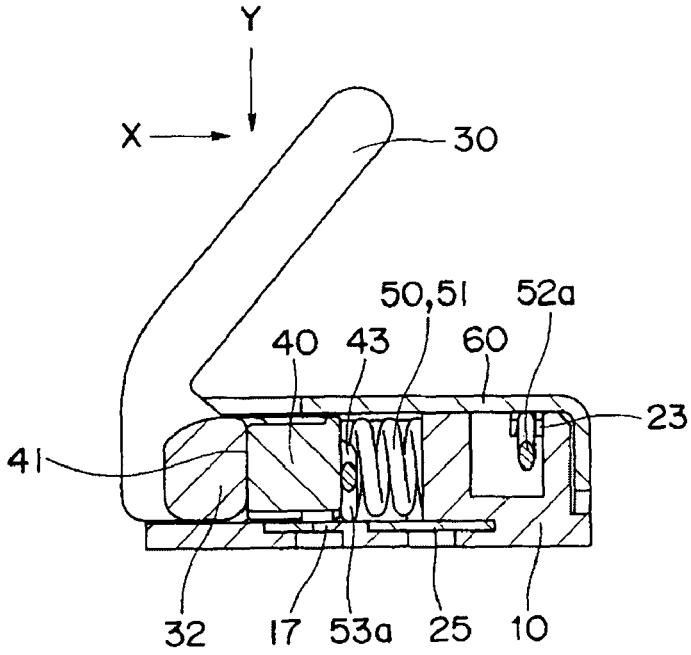
Figure 34A:
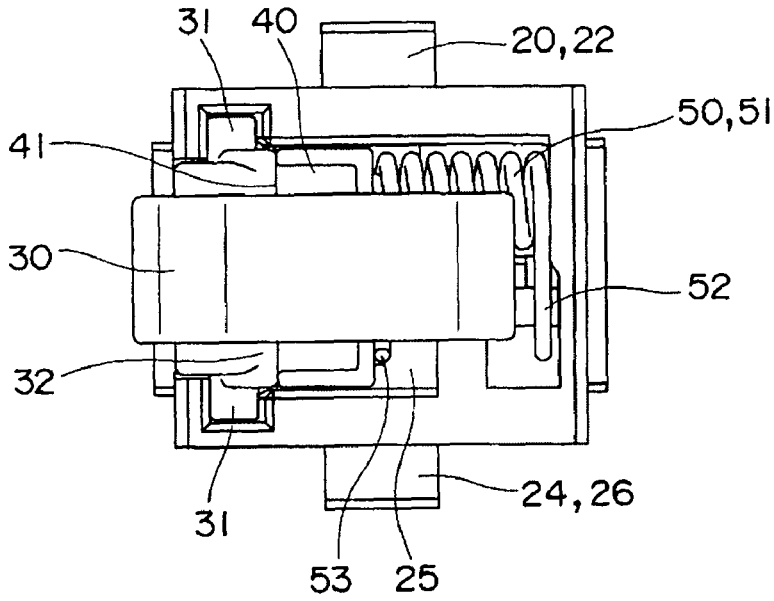
FIGS. 34A and 34B respectively show a plan view in middle of the operation in which the cover is detached, and a cross sectional view in middle of the operation in which the cover is attached.
Figure 34B:
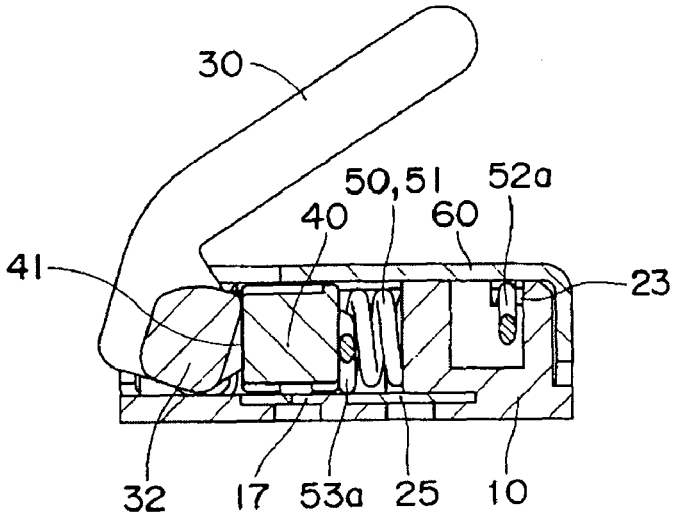

Thus, as shown in FIG. 33, when external force is loaded to the operation lever 30 in the direction of the arrow X or Y, the operation lever 30 pivots with the shaft part 31 as the center against the spring force of the coil spring 50. The cam part 32 of the operation lever 30 then pushes the pressure receiving surface 41 of the slider 40 and the slider 40 slides on the base 10, thereby compressing the coil part 51 of the coil spring 50. The contacting point 53*a* of the coil spring 50 thus slides on the insulation part 17 of the base 10, and contacts a switching fixed contact point 25, as shown in FIG. 34. The second common fixed contact point 23 and the switching fixed contact point 25 are thereby short circuited by way of the coil spring 50, and the fixed contact point terminals 20, 24 become electrically conductive.

Figure 35A:
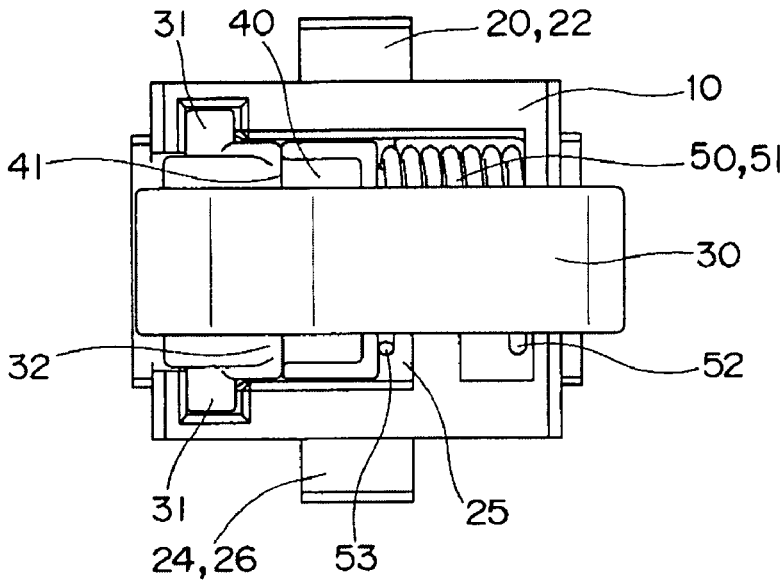
FIGS. 35A and 35B respectively show a plan view of after the operation in which the cover is detached, and a cross sectional view of after the operation in which the cover is attached.
Figure 35B:
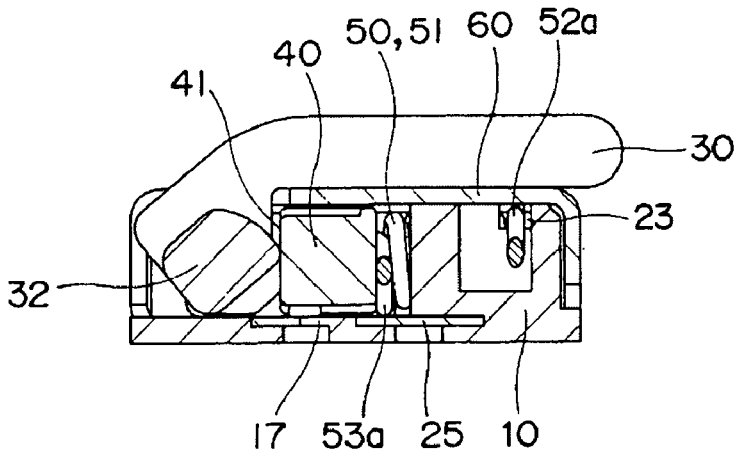

Furthermore, when the operation lever 30 is pushed down, the contacting point part 53*a* of the arm part 53 slides on the fixed contact point 25, and the fixed contact point terminals 20, 24 maintain the conduction state, as shown in FIG. 35. The operation lever 30 then contacts the cover 60 and stops.

When the load is thereafter released, the operation lever 30 is pushed back by way of the slider 40 by the spring force of the coil spring 50, and the contacting point part 53*a* of the coil spring 50 opens and separates from the fixed contact point 25 and contacts the insulation part 17, whereby the fixed contact point terminals 20, 24 become non-electrically conductive.

The present invention is not limited to the above described switches, and may be applied to switches of other forms.

What is claimed is:

1. A switch comprising:

a base including at least one switching fixed contact point exposed from a bottom surface and a concave part having at least one pair of opposing side walls;

an operation lever pivotally supported by the side walls of the base;

a slider slidably arranged on the bottom surface of the base for sliding while being guided by the opposing side walls of the base when pushed by a cam part of the operation lever; and a conductive coil spring arranged on the bottom surface of the base so as to extend and contract with push and release by the slider, including an arm part on a first end side arranged to be slidable on the bottom surface of the base and arranged so as to contact and separate with respect to the switching fixed contact point; wherein a shaft center of the coil spring is arranged parallel to a moving direction of the slider.

2. A switch according to claim 1, wherein the shaft center of the coil spring intersects a central part of the slider.

3. A switch according to claim 1, wherein the shaft center of the coil spring intersects the slider at a position deviated from a central part thereof.

4. A switch according to claim 1, wherein a coil part of the coil spring contacts a common fixed contact point exposed from the bottom surface of the base.

5. A switch according to claim 1, wherein a second end of the coil spring contacts the common fixed contact point exposed from an inner side surface of the base.

6. A switch according to claim 2, wherein a coil part of the coil spring contacts a common fixed contact point exposed from the bottom surface of the base.

7. A switch according to claim 3, wherein a coil part of the coil spring contacts a common fixed contact point exposed from the bottom surface of the base.

8. A switch according to claim 2, wherein a second end of the coil spring contacts the common fixed contact point exposed from an inner side surface of the base.

9. A switch according to claim 3, wherein a second end of the coil spring contacts the common fixed contact point exposed from an inner side surface of the base.

* * * * *